US006152714A

United States Patent [19]

Mitsuya et al.

[11] Patent Number: 6,152,714

[45] Date of Patent: Nov. 28, 2000

[54] DISPLACEMENT TYPE FLUID MACHINE HAVING ROTATION SUPPRESSION OF AN ORBITING DISPLACER

[75] Inventors: Shunichi Mitsuya; Hirokatsu Kohsokabe, both of Ibaraki-ken; Masahiro Takebayashi, Tsuchiura; Koichi Inaba; Hiroaki Hata, both of Tochigi-ken; Kenji Tojo, Ibaraki-ken, all of Japan

[73] Assignee: Hitachi, Ltd., Tokyo, Japan

[21] Appl. No.: 08/932,921

[22] Filed: Sep. 18, 1997

[30] Foreign Application Priority Data

Sep. 20, 1996 [JP] Japan ..... 8-249738

[51] Int. Cl.[7] ..... F01C 1/04; F01C 21/04

[52] U.S. Cl. ..... 418/61.1

[58] Field of Search ..... 418/54, 51.1, 55.3, 418/61.1, 55.6

[56] References Cited

U.S. PATENT DOCUMENTS

| | | | |
|---|---|---|---|
| 1,277,437 | 9/1918 | Lind | 418/61.1 |
| 1,864,699 | 6/1932 | Varley | 418/54 |
| 2,112,890 | 4/1938 | Gunn | 418/94 |

FOREIGN PATENT DOCUMENTS

| | | | |
|---|---|---|---|
| 589 419 | 3/1934 | Germany | 418/61.1 |
| 55-23353 | 2/1980 | Japan | 418/54 |
| 3-275996 | 12/1991 | Japan | 418/61.1 |
| 5-133358 | 5/1993 | Japan | 418/55.6 |
| 5-202869 | 8/1993 | Japan | 418/61.1 |
| 6-280758 | 10/1994 | Japan | 418/61.1 |

*Primary Examiner*—John J. Vrablik
*Attorney, Agent, or Firm*—Antonelli, Terry, Stout & Kraus, LLP

[57] ABSTRACT

A conventional displacement type fluid machine involves a problem that a mechanical friction loss and leakage in sliding portions are large, so that its reliability and performance are poor, and therefore it has not yet been put into practical use. In a displacement type fluid machine, a displacer makes an orbital motion within a cylinder to draw and discharge a working fluid. An compression element includes the displacer of a specified configuration, and the cylinder engaged with this displacer, and a connecting member (rotation prevention member), which abuts against the displacer and the cylinder, is provided inwardly of compression working chambers. With this construction, a rotating moment acting on the displacer can be completely avoided, thereby achieving the high efficiency and the high reliability.

9 Claims, 28 Drawing Sheets

DISPLACEMENT TYPE FLUID MACHINE HAVING ROTATION SUPPRESSION OF AN ORBITING DISPLACER

BACKGROUND OF THE INVENTION

1. Field of the Invention

This invention relates to a displacement type fluid machine such as a compressor, a pump and an expander.

2. Description of the Related Art

As displacement type fluid machines, there have been long known a reciprocating fluid machine in which a piston is reciprocally moved repeatedly in a cylinder to move a working fluid, a rotary (rolling piston-type) fluid machine in which a cylindrical piston makes an eccentric rotary motion in a cylinder to move a working fluid, and a scroll fluid machine in which a pair of stationary and orbiting scrolls, each having a wrap of a volute configuration formed perpendicularly on an end plate, are engaged with each other, and a working fluid is moved by revolving the orbiting scroll.

The reciprocating fluid machine has an advantage that it can be easily manufactured, and is inexpensive since its construction is simple, but a stroke from the end of the suction to the end of the discharge is as short as 180° in terms of an angle of rotation of a shaft, and the flow velocity during the discharge stroke becomes high, which invites a problem that the performance is lowered because of an increased pressure loss, and since the motion for reciprocating the piston is required, the rotation shaft system can not be perfectly balanced, so that large vibrations and noises are produced.

In the rotary fluid machine, a stroke from the end of the suction to the end of the discharge is 360° in terms of an angle of rotation of a shaft, and therefore the problem that a pressure loss increases during the discharge stroke is less serious as compared with the reciprocating fluid machine. However, a fluid is discharged for each rotation of the shaft, and therefore a variation in a gas compression torque is relatively large, which invites vibration and noise problems as in the reciprocating fluid machine.

In the scroll fluid machine, a stroke from the end of the suction to the end of the discharge is as long as more than 360° in terms of an angle of rotation of a shaft (usually, about 900° in a scroll fluid machine put into practical use for air-conditioning purposes), and therefore a pressure loss during the discharge stroke is small, and, generally, a plurality of working chambers are formed, and therefore there is achieved an advantage that a variation in a gas compression torque is small, so that vibrations and noises are small. However, it is necessary to control a clearance between the volute wraps, engaged with each other, as well as a clearance between the end plate and the tip of the wrap, and therefore high-precision processing or working is needed, which invites a problem that the processing cost is high. Besides, since the stroke from the end of the suction to the end of the discharge is as long as more than 360° in terms of the rotational angle of the shaft, the time for the compression stroke is long, which invites a problem that an internal leakage increases.

Proposed in Japanese Patent Unexamined Publication No. 55-23353 (Document 1) and U.S. Pat. No. 2,112,890 (Document 2) are a kind of displacement type fluid machines in which a displacer (hereinafter referred to also as "orbiting piston") for moving a working fluid does not rotate about its axis relative to a stationary member (hereinafter referred to also as "cylinder"), but revolves (that is, makes an orbital motion) relative to the stationary member with a generally constant radius, thereby conveying the working fluid.

In the displacement type fluid machine proposed in these publications, the piston having a radial configuration (in a plan view) formed by a plurality of arcs, and the cylinder having a radial inner surface (in a plan view) disposed a predetermined distance from the outer periphery of the piston are combined together, and the piston is caused to make an orbital motion within the cylinder, thereby conveying, compressing and expanding the working fluid.

The displacement type fluid machines disclosed in the above Document 1 and Document 2 do not have any reciprocating portion as in a reciprocating machine, and therefore the rotation shaft system can be completely balanced. Therefore, vibrations are small, and also the speed of relative slip between the piston and the cylinder is low, so that a friction loss can be reduced to a relatively small value, which is an essentially advantageous feature for the displacement type fluid machine.

However, the stroke from the end of the suction to the end of the discharge in each of the working chambers formed by a plurality of vanes (constituting the piston) and the cylinder is as short as about 180° in terms of the angle θ of rotation of the shaft (this is about a half of that of the rotary type, and is about the same as that of the reciprocating type), and therefore the flow velocity of the fluid becomes high during the discharge stroke to cause an increase in pressure loss, which invites a problem that the performance is lowered. In the fluid machines disclosed in the above Document, a rotating moment, which is produced as a reaction force of the compressed working fluid and tends to rotate the orbiting piston, is exerted on the orbiting piston, and the arc-shaped portions of the orbiting piston bears such rotating moment. However, the compression working chambers formed by the orbiting piston and the cylinder during the stroke from the end of the suction to the end of the discharge are disposed in a concentrated manner on one side of the drive shaft, and therefore the rotating moment acting on the orbiting piston becomes excessive due to the pressure within the compression working chambers, and as a result the gap between the orbiting piston and the cylinder is enlarged to increase the leakage of the working fluid between the compression working chambers and the cylinder (because of temporary deformation and wear), and therefore there has been encountered a problem that the performance is lowered.

The rotating moment is born by the points of contact between the orbiting piston and the cylinder, and therefore there has been encountered a problem that the reliability is lowered.

The stroke from the end of the suction to the end of discharge in the compression working chambers formed by the orbiting piston and the cylinder is as short as about 180 degrees in terms of the angle of rotation of the shaft to increase the flow velocity during the discharge stroke and decrease a pressure loss, which invites a problem that the performance is lowered.

SUMMARY OF THE INVENTION

It is an object of this invention to provide a displacement type fluid machine in which a rotating moment acting on an orbiting piston is suppressed, and a gap between an orbiting piston and a cylinder is kept optimum to reduce friction and wear, thereby improving the performance and the reliability.

The above object has been achieved by a displacement type fluid machine comprising a displacer and a cylinder which are provided between end plates;

wherein when a center of the displacer and a center of the cylinder are aligned with each other, one space is formed by an outer peripheral surface of the displacer and an inner peripheral surface of the cylinder, and when the displacer is set to an orbiting position, a plurality of spaces are formed by the outer peripheral surface of the displacer and the inner peripheral surface of the cylinder; and wherein there is provided means for suppressing the rotation of the displacer.

The above object has also been achieved by a displacement type fluid machine comprising a cylinder provided between end plates, the cylinder having an inner peripheral surface formed by curves continuous with one another in its plan view; and a displacer having an outer peripheral surface disposed in opposed relation to the inner peripheral surface of the cylinder;

wherein when the displacer makes an orbital motion, a plurality of spaces are formed by the inner peripheral surface, the outer peripheral surface and the end plates; and wherein there is provided rotation suppression means for suppressing the rotation of the displacer.

The above object has also been achieved by a displacement type fluid machine comprising a displacer and a cylinder which are provided between end plates;

wherein when a center of the displacer and a center of the cylinder are aligned with each other, one space is formed by an outer peripheral surface of the displacer and an inner peripheral surface of the cylinder, and when a positional relation between the displacer and the cylinder is set to an orbiting position, a plurality of spaces are formed by the outer peripheral surface of the displacer and the inner peripheral surface of the cylinder; and wherein a connecting member, which is abutted against the displacer and the end plate, is provided inwardly of the plurality of spacers.

With the above construction, a rotating moment, which serves as a reaction force of compressed working fluid and tends to rotate the orbiting piston (displacer), can be completely canceled to enable imparting a proper orbital motion to the orbiting piston, and the gap between the compression chambers can be kept in the optimum condition, and therefore the unwanted contact of the displacer with the cylinder due to action of the rotating moment is eliminated, and temporary deformation and wear due to the rotating moment are reduced, and therefore there can be provided the displacement type fluid machine which can be operated with high efficiency and high reliability for a long period of time.

DESCRIPTION OF THE PREFERRED EMBODIMENTS

Figure 1:
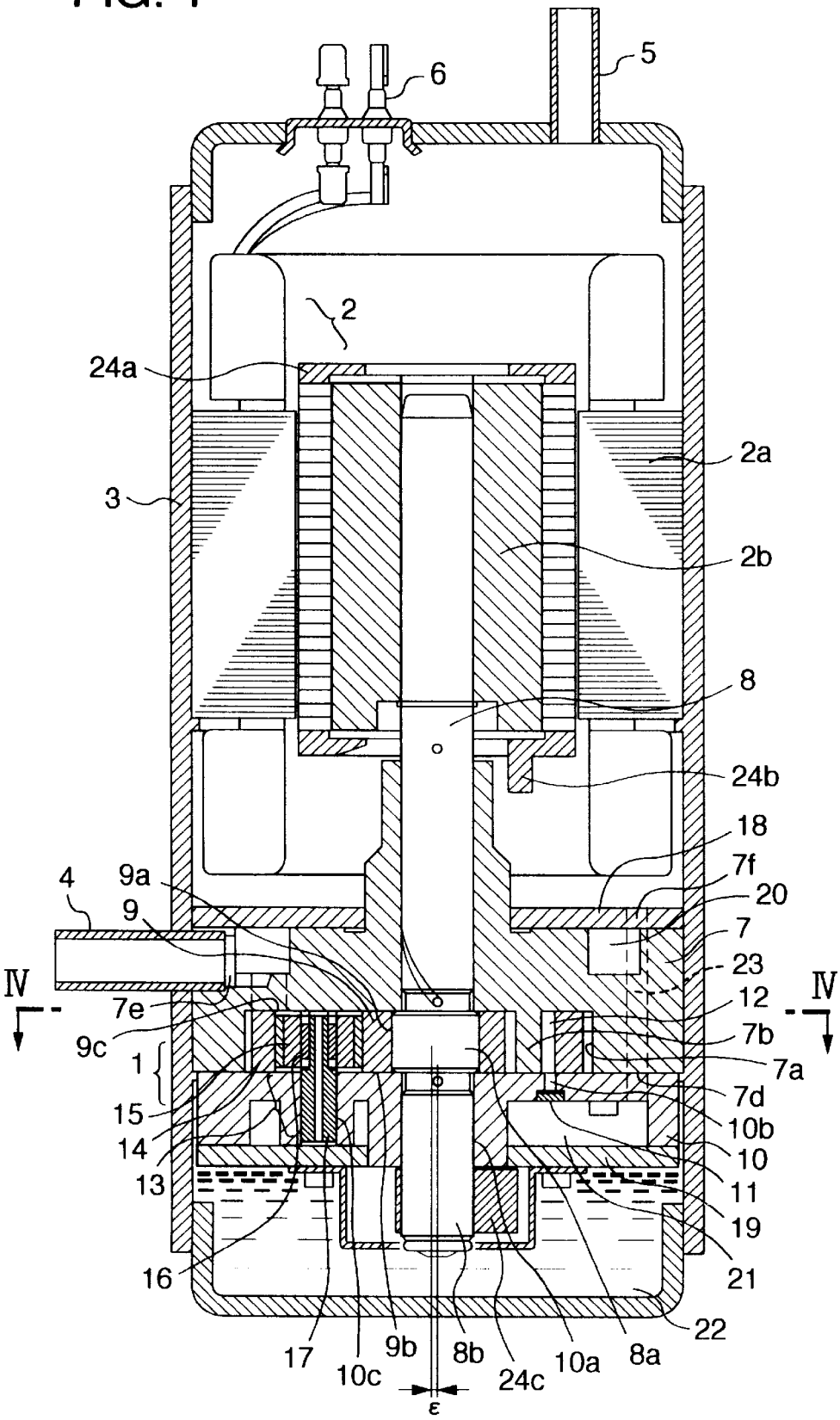
FIG. 1 is a vertical cross-sectional view showing a displacement type compressor according to an embodiment of the invention.
Figure 2:
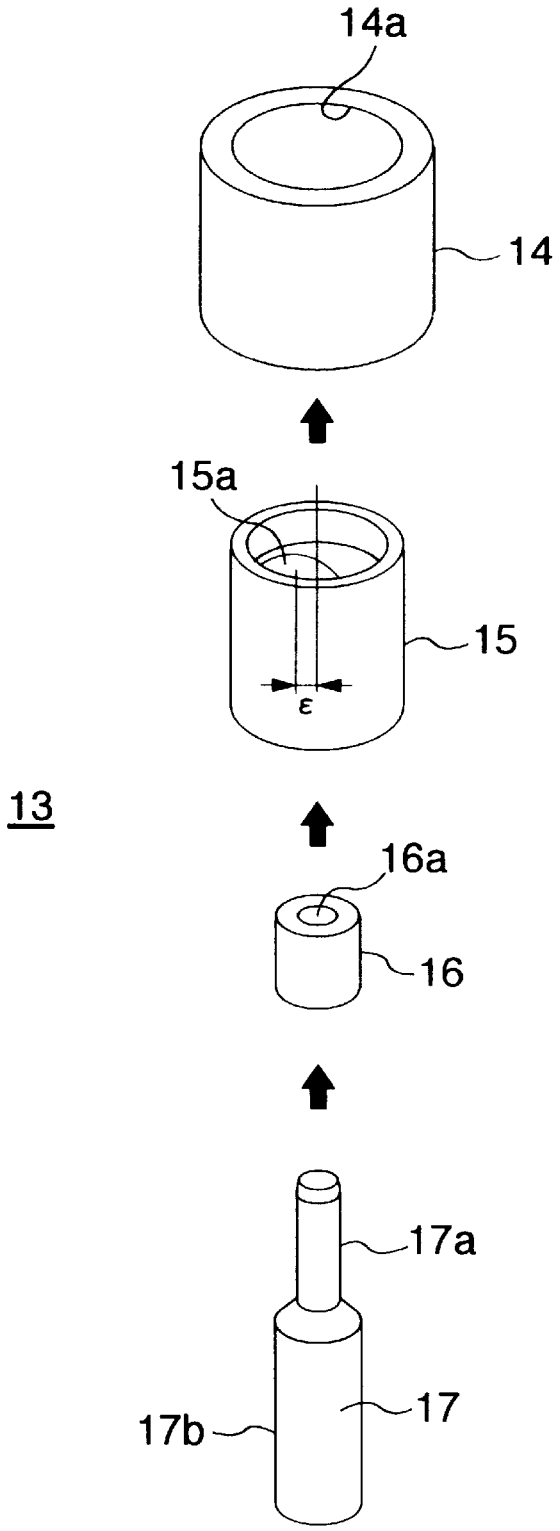
FIG. 2 is a view showing an appearance of a pin-type rotation prevention mechanism of the invention.
Figure 3:
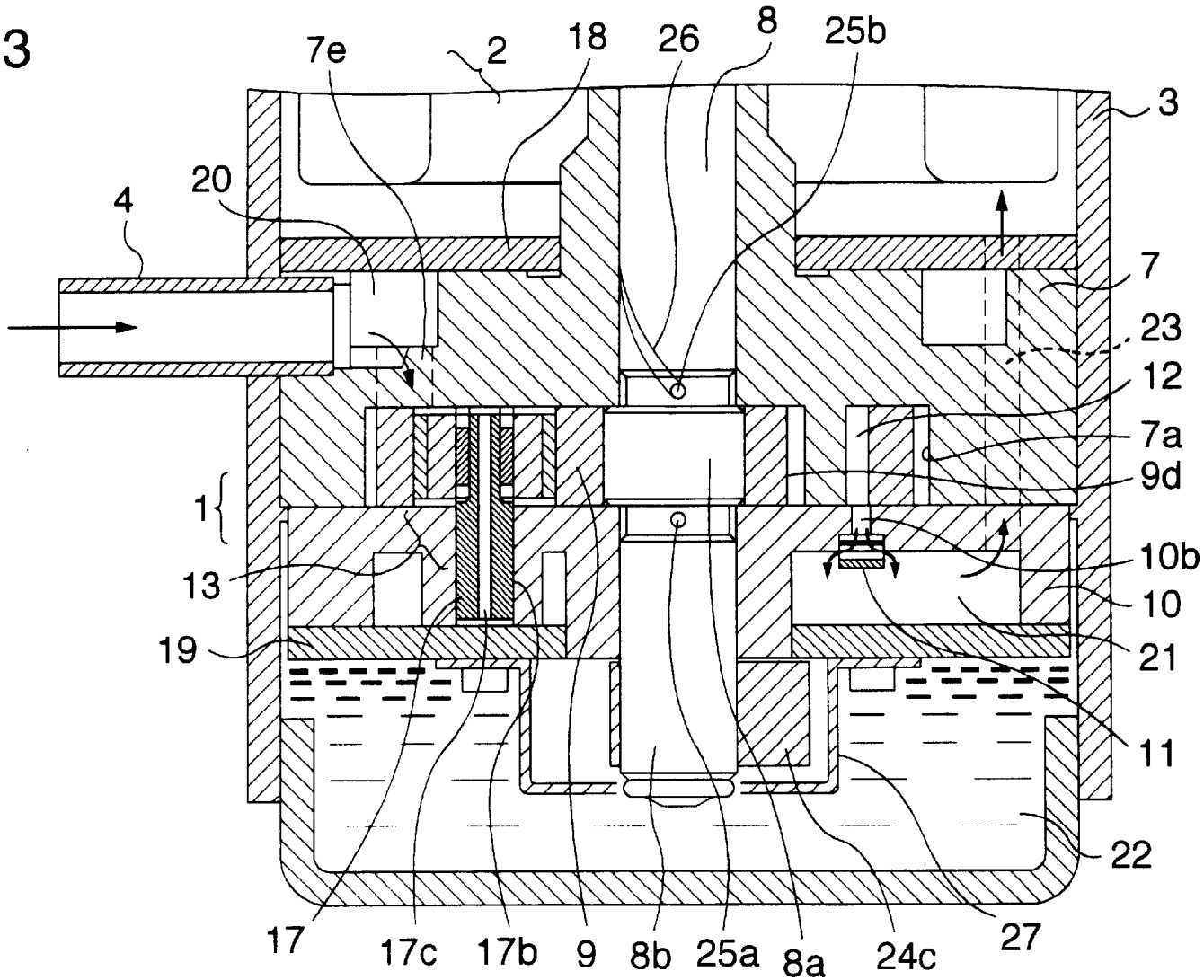
FIG. 3 is a vertical cross-sectional view of a compression element portion in FIG. 1.

A preferred embodiment of the present invention will now be described in detail with reference to the drawings. FIG. 1 is a vertical cross-sectional view of a first embodiment of a displacement type fluid machine of the invention, FIG. 2 is a view showing an appearance of a pin-type rotation prevention mechanism, FIG. 3 is a vertical cross-sectional view showing a compression element in FIG. 1, and FIG. 4 is a plan view taken along the line IV—IV of FIG. 1, showing the principle of the operation of the compression element.

In FIG. 1, the reference numeral 1 denotes the compression element of the invention, 2 an electrically-operating element for driving this compression element, and 3 a closed vessel or container containing the compression element 1 and the electrically-operating element 2, and this vessel 3 is provided with a suction (intake) pipe 4, a discharge pipe 5 and current-leading terminals 6.

The configuration of the compression element 1 as well as the principle of its operation will be described with reference to FIGS. 4A to 4D. FIGS. 4A to 4D are views taken along the line IV—IV of FIG. 1. In these Figures, the character O denotes the center of an orbiting piston 9, and O' denotes the center of a cylinder 7 and the center of a drive shaft 8. The configuration of an inner peripheral surface of the cylinder 7 is formed by combining three volute portions, each formed by a multi-arc-shaped curve, together in smoothly-continuous relation to one another. Referring to one of these volute portions, those curves, respectively, forming an inner peripheral surface 7*a* and a vane 7*b* can be regarded as one deep volute curve, and its inner wall curve is a volute curve (a-g in FIG. 4A) having a substantial winding angle of 360 degrees (which means that although this angle is 360 degrees in design, it fails to accurately coincide with this value because of manufacturing tolerances), and its outer wall curve is a volute curve (g-b in FIG. 4A) having a substantial winding angle of 180 degrees. The above one volute curve is formed by a tangential curve connecting the inner wall curve and the outer wall curve together.

The configuration of an outer peripheral surface of the orbiting piston 9 is also formed according to the same principle as described for the cylinder 7, and this outer peripheral surface shape is similar to the shape or contour of the inner peripheral surface of the cylinder 7 and is smaller than it by an amount corresponding to the radius $\epsilon$ (=OO') of revolution (orbital motion). As shown in the drawings, an eccentric portion 8*a* of the drive shaft 8 is inserted or fitted in a bearing hole 9*a* in the orbiting piston 9, so that the orbiting piston 9 and the cylinder 7 are engaged with each other to be eccentric with respect to each other by an amount equal to the orbital radius $\epsilon$. The characters a, b, c, d, e and f denote points of contact (engagement) between the outer peripheral surface of the orbiting piston 9 and the inner peripheral surface of the cylinder 7.

Three holes 9*c*, 9*e* and 9*f* are formed in the orbiting piston 9 to be positioned equidistantly with respect to the center O and circumferentially disposed at equal intervals, thus providing an equal-pitch arrangement. Pin-type rotation prevention mechanisms 13*a*, 13*b* and 13*c* are mounted in the holes 9*c*, 9*e* and 9*f*, respectively. The character O1 denotes the center of the orbiting piston 9, a bearing member 14 and an eccentric member 15, and O1' denotes the center of a hole 15*a* in the eccentric member 15, a bearing member 16 and a pin member 17. A distance between the center O1 and the center O1' is equal to the orbital radius $\epsilon$ which is the distance between the center O of the orbiting piston 9 and the center of the cylinder 7.

For a compression operation, when the drive shaft 8 is rotated, the orbiting piston 9 fitted on the eccentric portion 8*a* revolves (i.e., makes an orbital motion) around the center of the cylinder 7 with the orbital radius $\epsilon$, so that a plurality of compression working chambers 12 are formed around the center of the orbiting piston 9. For the compression working chamber 12 formed between the contact point a and the contact point b (the chamber is divided into two compression working chambers, with a discharge port interposed therebetween, at the time of the end of the suction stroke, but these two chambers are combined into one chamber immediately when the compression stroke begins. Hereinafter, the compression working chamber will be defined as follows. Among the plurality of compression working chambers each surrounded and closed by the contour of the inner periphery of the cylinder (i.e., inner wall surface of the cylinder) and the contour of the outer periphery of the piston (that is, side walls of the piston), those spaces, in which the suction stroke has been finished and the compression (discharge) stroke is being effected, will be referred to as "compression operation space". Such space disappears when the compression is finished, but the suction is also finished at this moment, and therefore the space is counted as one space. However, when the fluid machine is used as a pump, those spaces communicating with the discharge port will be referred to as "compression working chamber".), FIG. 4A shows a state in which the drawing of the working fluid into this compression working chamber 12 from a suction port 7*e* is finished, FIG. 4B showing a state resulted from rotating the drive shaft 8 clockwise through 90 degrees from this state, FIG. 4C showing a state e resulted from rotating the drive shaft 8 clockwise through 90 degrees from the state of FIG. 4B, and FIG. 4D showing a state resulted from rotating the drive shaft 8 clockwise through 90 degrees from the state of FIG. 4C, and when the drive shaft 8 is further rotated clockwise through 90 degrees, the compression element is returned to the initial state of FIG. 4A.

Figures 4A, 4B, 4C, 4D:
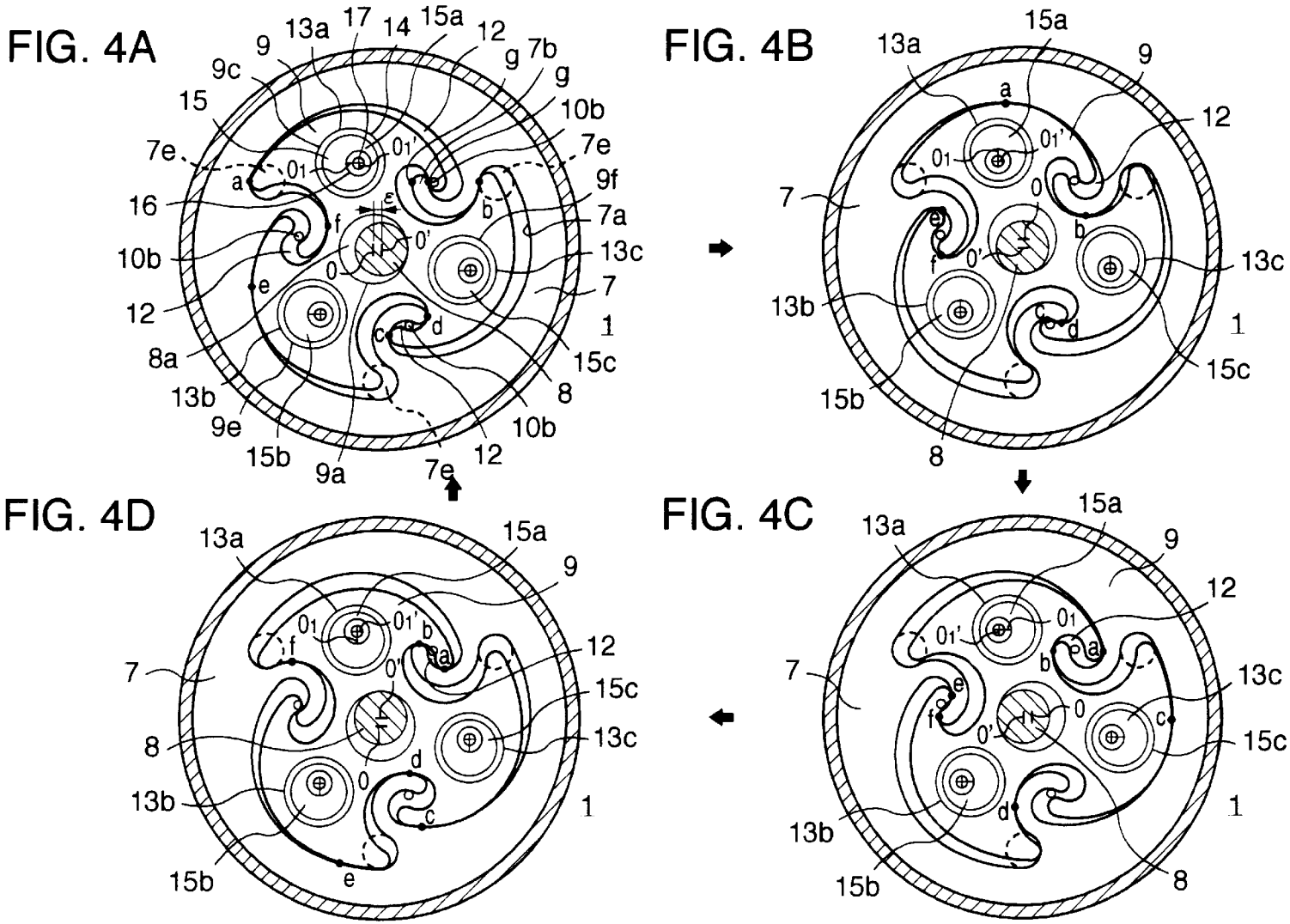
FIGS. 4A to 4D are plan views taken along the line IV—IV of FIG. 1, showing the principle of an operation of the compression element.

For example, for a space formed between the contact points a and f (FIG. 4A), the suction has already been started at the stage of FIG. 4A, and as the rotation proceeds, its volume increases. When the state of FIG. 4D is established, this space is divided into sections. A fluid corresponding to the divided sections is supplied from the space formed between the contact points b and c. Specifically, for the working chamber formed between the contact points a and b (FIG. 4A), the suction has already begun in the adjacent space formed between the contact points a and f, and the fluid in this space is to be compressed by the space formed between the contact points a and b after the shaft rotates through 360 degrees. However, this space is once expanded as shown in FIG. 4C, and then is divided into sections when the state of FIG. 4D is established, and therefore all of the fluid in the space formed between the contact points a and f is not compressed by the space formed between the contact points a and b. The fluid of an amount equal to the fluid volume, which has not been taken into the space between the contact points a and f as a result of the division, is compensated for by the fluid entering into a space between a contact point near to the discharge port and the contact point b, which the space formed between the contact points b and c (FIG. 4D) in the process of the suction is divided as shown in FIG. 4A to form. This is because of not an unequal-pitch arrangement but of the equal-pitch arrangement is provided as described above. Namely, the configuration of the orbiting piston as well as the configuration of the cylinder is formed by repeating the same contour, whereby even if any of the working chambers obtains the fluid from another space, it can compresses the fluid of substantially the same amount. Even with the unequal-pitch arrangement, the processing or working can be effected so that the volumes of the spaces can be equal to each other, but in this case the manufacturing efficiency is poor. Thus, the space adjacent to the operating chamber in the process of the suction is divided so as to effect the compression operation, which constitutes one feature of this displacement type fluid machine.

Therefore, as the rotation of the drive shaft 8 proceeds, the volume of the compression working chamber 12 is reduced, so that the working fluid is compressed since the discharge port 10*b* is closed by a discharge valve.

When the pressure within the compression working chamber 12 becomes higher than an outside discharge pressure (i.e., the pressure within the closed vessel), the discharge valve is automatically opened by the pressure difference, and the compressed working fluid is discharged through the discharge port 10*b*. The angle of rotation of the shaft from the end of the suction (the start of the compression) to the end of the discharge is 360 degrees (larger than 180 degrees), and while the compression and discharge strokes are effected, the next suction stroke is prepared, and when the discharge is finished, the next compression is started. Namely, the compression working chambers 12 are disposed at regular pitch relative to the center O of the orbiting piston to be circumferentially disposed from one another, and the compression working chambers 12 continuously effect the suction and compression strokes in a phase-shifting manner, whereby a torque pulsation per rotation of the drive shaft 8 is lessened to enable reducing vibrations and noises in the displacement type fluid machine.

In the displacement type fluid machines disclosed in the above-mentioned Document, a time period, during which any of the suction ports communicates with the adjacent discharge port, exists during the revolution (orbital motion) of 360 degrees, and in this state such space does not contribute to the compression and the suction, thus lowering the efficiency, and one half effects the compression operation while the other half makes no contribution, which causes a problem that the load at the compression side acts on the shaft.

On the other hand, in this embodiment, spaces formed by the inner wall surface and the outer wall surface are always placed in the compression stroke (including the discharge) or the suction stroke, so that the efficiency is high and uniform formation of the compression chambers provides a less unbalance of the compression pressure, and lessens the moment for rotating the orbiting piston about its axis in principle.

Next, the overall construction will be described with reference to FIG. 1.

The compression element 1 comprises the cylinder 7, which includes the arc-like vanes 7*b* projecting inwardly from the inner peripheral surface 7*a*, and a main bearing portion 7*c* bearing the drive shaft 8, the orbiting piston 9 which is engaged with the vanes 7*b* of the cylinder 7, and has the bearing hole 9*a* which is formed through its central portion, and is fitted on the eccentric portion 8*a* of the drive shaft 8 which is eccentric by an amount equal to the orbital radius $\epsilon$, an auxiliary bearing member 10 adapted to abut against end surfaces 7*d* and 9*b* of the cylinder 7 and orbiting piston 9 and having an auxiliary bearing portion 10*a* bearing the drive shaft 8, the suction ports 7*e* formed in the cylinder 7, the discharge ports 10*b* formed in the auxiliary bearing member 10, and the reed-type discharge valve 11 for opening and closing the discharge port 10*b*. The reference numeral 12 denotes the compression working chambers formed by the vanes 7*b* of the cylinder 7 and the orbiting piston 9.

As shown in FIG. 2, the pin-type rotation prevention mechanism 13 comprises the bearing member 14, the eccentric member 15, the bearing member 16, and the pin member 17. The bearing members 14, respectively, are fitted in and fixed to the holes 9*c*, 9*e* and 9*f* which are formed to be circumferentially disposed at equal intervals around the center of the orbiting piston 9. The eccentric hole 15*a* is formed in the eccentric member 15, and the distance between the center of the eccentric member 15 and the center of the hole 15*a* is equal to the eccentric amount $\epsilon$ (=orbital radius) of the eccentric portion 8*a* of the drive shaft 8. The eccentric member 15 is slidably fitted in a hole 14*a* in the bearing member 14. The bearing member 16 is fitted in and fixed to the hole 15*a* in the eccentric member 15, and a distal end portion 17*a* of the pin member 17 is slidably fitted in a central hole 16*a* formed axially through the bearing member 16. The distal end portion 17*a* of the pin member 17 is coaxial with the central hole 16*a* in the bearing member 16 fitted in the eccentric hole 15*a* in the eccentric member 15. Lower end portions 17*b* of the pin members 17, respectively, are fitted in and fixed to holes 10*c* which are formed in the auxiliary bearing member 10, the holes 10*c* being disposed to be circumferentially disposed at equal intervals around the center of the auxiliary bearing member 10. With this construction, the pin-type rotation prevention mechanisms 13 are provided.

A suction cover 18 is secured to an end surface 7*f* of the cylinder 7, and a discharge cover 19 is secured to an end surface 10*d* of the auxiliary bearing member 10, these covers 18 and 19, respectively, forming a suction chamber 20 and a discharge chamber 21 which are separated from that portion of the internal space of the closed vessel 3 containing the electrically-operating element 2. A lubricating oil 22 is stored in a bottom portion of the closed vessel 3, and a lower end 8*b* of the drive shaft 8 is immersed in this lubricating oil. A communication passage 23 communicates the discharge chamber 21 with the electrically-operating element-side space (containing the electrically-operating element 2).

The electrically-operating element 2 comprises a stator 2*a* and a rotor 2*b*, and the rotor 2*b* is fixedly mounted on one end portion of the drive shaft 8 by shrinkage fit or the like. Balancers 24*a*, 24*b* and 24*c*, respectively, are mounted on front and rear ends of the rotor 2*b* and the lower end portion 8*b* of the drive shaft 8, and the action of these balancers completely cancels an unbalance amount developing during the rotation. With this construction, the displacement type fluid machine of the vertical type is provided.

Next, the flow of the working fluid will be described with reference to FIG. 3. As indicated by arrows in FIG. 3, the working fluid entering into the closed vessel 3 through the suction pipe 4 flows into the compression element 1 via the suction chamber 20 formed by the suction port 7*e* and the suction cover 18 mounted on the cylinder 7, and when the drive shaft 8 is rotated by the electrically-operating element 2, the orbiting piston 9 fitted on the eccentric portion 8*a* of the drive shaft 8 revolves (that is, makes an orbital motion), so that the volume of the compression working chamber 12 is reduced, thereby effecting the compression operation. The compressed working fluid opens the discharge valve 11 via the discharge port 10*b* to be led to the discharge chamber 21, and pass through the communication passage 23 and the electrically-operating element 2 to be discharged from the discharge pipe (512 FIG. 1) to the exterior of the compressor.

At this time, a high discharge pressure acts on the lubricating oil 22 stored in the bottom portion of the closed vessel 3, whereby the lubricating oil 22 is fed by a centrifugal pumping action into an oil feed hole (not shown) formed in the drive shaft to be supplied to the sliding portions (including the main bearing portion 7*c* of the cylinder 7, the auxiliary bearing portion 10, the inner peripheral surface 7*a* of the cylinder 7, and the outer peripheral surface 9*d* of the orbiting piston 9) via oil feed holes 25*a* and 25*b* (communicating with the above oil feed hole in the drive shaft 8) and an oil feed groove 26. The lubricating oil fed into the compression working chambers via the various sliding portions merges into the working fluid to flow from the discharge chamber 21 through the communicating passage 23 to cool the electrically-operating element 2, thus constituting an oil feed path, in which it is separated from the working fluid and is returned to the bottom portion of the closed vessel 3. An oil feed hole 17*c* is formed in the pin member 17 of the rotation prevention mechanism 13 to be in communication with the lubricating oil 22 in the bottom portion of the closed vessel 3 via an oil feed hole (not shown) formed in the discharge cover 19 disposed at the lower end portion 17*b* of the pin member 17. With this construction, the members, constituting the rotation prevention mechanism 13 are lubricated by a centrifugal pumping action. Provided at the lower surface of the discharge cover 19 is an oil cover 27 for reducing the influence produced by the stirring of the lubricating oil 22 caused by the rotation of the balancer 24*c* mounted on the lower end portion 8*b* of the drive shaft 8.

Next, the rotation prevention mechanism will be described in detail. In FIGS. 4A to 4D, the pin members 17, which are disposed at equal intervals around the center O' of the auxiliary bearing member 10, and are fixed and supported in the same direction as the orbital radius $\epsilon$, are slidably fitted respectively in the holes 15*a* of the eccentric members 15 of the pin-type rotation prevention members 13 mounted on the orbiting piston 9. With this construction, the eccentric members 15*a*, 15*b* and 15*c* (which are mounted respectively on the pin members 17, and are fitted respectively in the holes 9*c*, 9*e* and 9*f* in the orbiting piston 9), while slipping in the respective holes 9*c*, 9*e* and 9*f*, make an orbital motion, relatively equal to that of the orbiting piston 9, with the distance (=orbital radius $\epsilon$) between the center O of the orbiting piston 9 and the center O' of the cylinder 7 in the sequence of FIGS. 4A, 4B, 4C, 4D and 4A.

As a result, in this embodiment, the pin-type rotation prevention mechanisms 13 acts to enable imparting a positive orbital motion to the orbiting piston 9, and also keeping a gap at the point of contact between the orbiting piston 9 and the cylinder 7 constant, whereby the friction and wear can be reduced to provide the displacement type compressor of a high reliability. Furthermore, the pin-type rotation prevention mechanisms 13 can be disposed inwardly of the compression working chambers 12 formed by the orbiting piston 9 and the cylinder 7, so that the compression element 1 can be formed with a smaller diameter.

In the compression element 1 of this embodiment, the compression working chambers 12, in which the angle of rotation of the shaft from the end of the suction to the end of the discharge is 360 degrees, are disposed to be disposed at equal intervals around the eccentric portion 8*a* of the drive shaft 8, so that the operating point of the rotating moment can be disposed nearer to the center of the orbiting piston 9, and therefore there is obtained a feature that the rotating moment, acting on the orbiting piston 9, is small.

In the compression element 1 of this embodiment, the compression stroke is finished in a short time to enable reducing the leakage of the working fluid, and improving the ability and efficiency of the displacement type compressor.

On the other hand, the discharge stroke is longer than that in a conventional rolling-type machine to be slow in the flow velocity of the working fluid at the time of the discharge, so that a pressure loss is reduced and a fluid loss (excess compression loss) during the discharge is greatly reduced, thereby achieving an improvement in the performance of the compressor. Besides, there is no need to use volute configurations and end plates as in a scroll-type machine, so that the time required for processing or working the parts, as well as the cost, can be reduced, and since a thrust load does not act on the above end plate, the axial gap, which determines the performance of the displacement type compressor, can be easily controlled to improve the performance.

The inner peripheral surface of the cylinder 7 and the outer peripheral surface of the orbiting piston 9 are similar in shape to each other, and are spaced a distance of the radial radius $\epsilon$ from each other. Therefore, the two members can be produced from the same material in one step, and therefore the productivity can be enhanced.

By applying a coating of excellent sliding properties to at least one of the outer peripheral surface of the orbiting piston 9 and the inner peripheral surface of the cylinder 7, the gap between the two members can be controlled at an initial stage of the operation of the displacement type compressor, and this prevents the performance from being lowered.

The displacement type compressor of this embodiment is a high-pressure system in which the interior of the closed vessel 3 is under the discharge pressure, and with this system, since the high pressure (discharge pressure) acts on the lubricating oil 22, the lubricating oil 22 can be easily supplied to the various sliding portions in the compressor by the above-mentioned centrifugal pumping action, and therefore the sealing properties of the compression working chambers as well as the lubrication of the various sliding portions can be enhanced.

Figure 5:
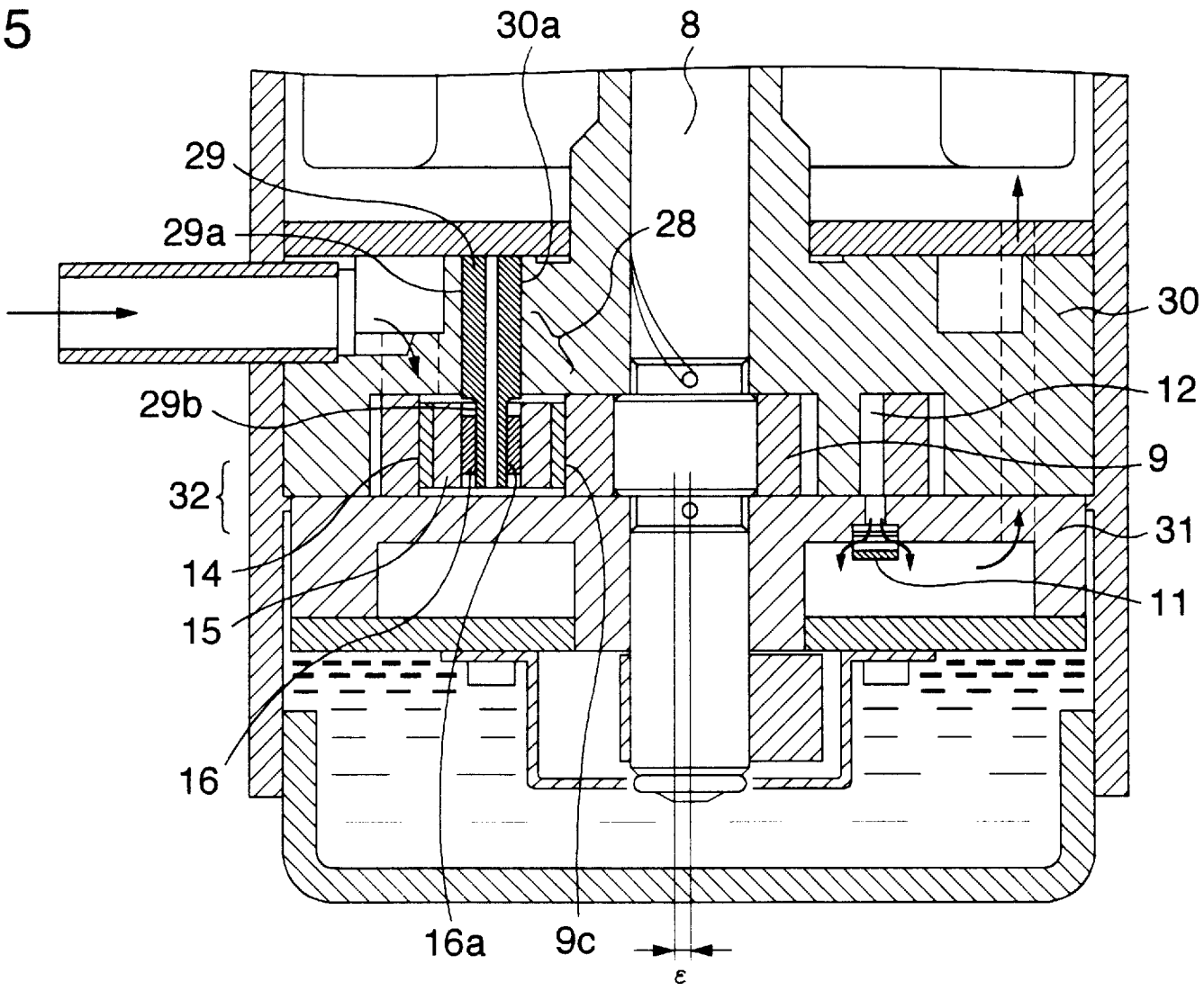
FIG. 5 is a vertical cross-sectional view showing a displacement type compressor according to an embodiment of the invention.

FIG. 5 is a vertical cross-sectional view showing a compression element of the present invention. In this embodiment, the arrangement of pin-type rotation prevention mechanisms 28 is different from that of FIG. 1, and this different portion will be mainly described.

Upper end portions 29*a* of pin members 29 of the pin-type rotation prevention mechanisms 28, respectively, are fitted in and fixed to holes 30*a* which are formed in a cylinder 30, and are disposed at equal intervals around the center of the cylinder 30. A lower end portion 29*b* of the pin member 29 is slidably inserted into a bearing hole 16*a* in a bearing member 16 of the rotation prevention mechanism 28 which comprises a bearing member 14, an eccentric member 15 and the bearing member 16, and the rotation prevention mechanisms 28, respectively, are provided in holes 9*c* in an orbiting piston 9. At this time, the distance between the center of the pin member 29 and the center of the eccentric member 15 and the hole 9*c* in the orbiting piston 9 is equal to the distance (orbital radius $\epsilon$) between the center of a drive shaft 8 and the center of the cylinder 30. The principle of the operation of the pin-type rotation prevention mechanisms 28 as well as the flow of a working fluid is similar to that described above for FIG. 1, and therefore explanation thereof will be omitted.

As a result, in this embodiment, similar effects as described for FIG. 1 can be obtained, and a rotating moment, tending to rotate the orbiting piston 9 by the internal pressure of compression working chambers 12 produced when the working fluid is compressed, is completely avoided, and a positive orbital motion can be imparted to the orbiting piston 9. Besides, a gap at the point of contact between the orbiting piston 9 and the cylinder 30 can be kept constant, so that the displacement type compressor of a high reliability can be provided, in which the friction and wear can be reduced.

In this embodiment, the upper end portion 29*a* of the pin member 29 of the rotation prevention mechanism 28 is fixedly mounted in the hole 30*a* in the cylinder 30, and the projecting lower end portion 29*b* of the pin member 29 is inserted into the bearing hole 16*a* in the bearing member 16 of the rotation prevention mechanism 28 which comprises the bearing member 14, the eccentric member 15 and the bearing member 16, and with this construction the assembling efficiency and the productivity can be enhanced. Besides, the configuration of an auxiliary bearing member 31 having discharge valve 11 can be simplified.

Figure 6:
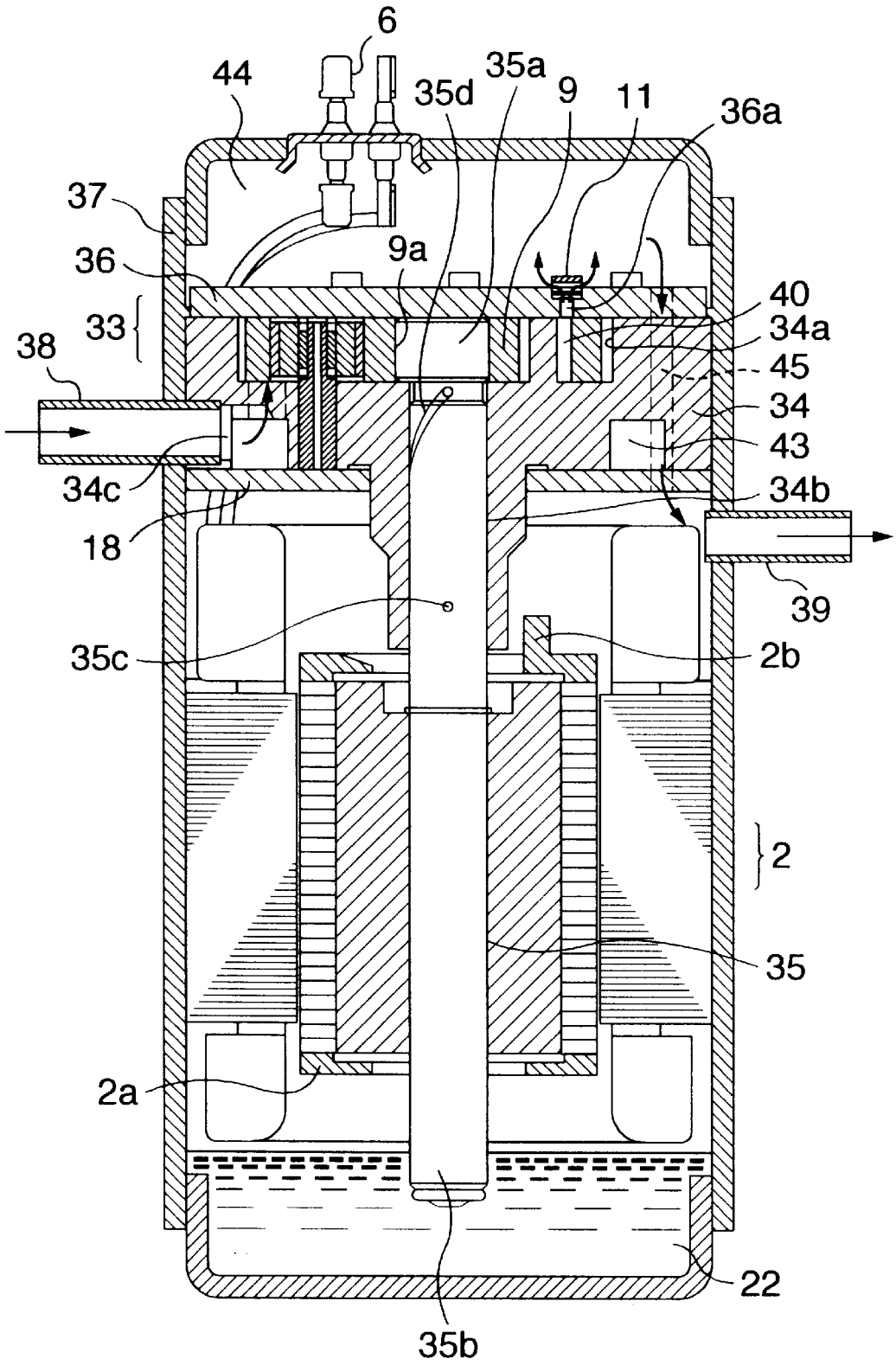
FIG. 6 is a vertical cross-sectional view showing a displacement type compressor according to an embodiment of the invention.

FIG. 6 is a vertical cross-sectional view showing a displacement type compressor of the present invention. In this embodiment, the arrangement of a compression element 33 is different from that of FIG. 1, and this different portion will be mainly described.

In FIG. 6, the compression element 33 is provided at an upper end portion of an electrically-operating element 2 for driving the compression element 33. An orbiting piston 9 of the compression element 33 is engaged with vanes 34*a* of a cylinder 34, and has a bearing hole 9*a* which is formed through its central portion and is fitted on an eccentric portion 35*a* of a drive shaft 35. The drive shaft 35 is borne by a main bearing portion 34*b* formed at the cylinder 34 to support the orbiting piston 9, fitted on the eccentric portion 35*a* of the drive shaft 35, in a cantilever manner.

A lower end portion 35*b* of the drive shaft 35 is immersed in the lubricating oil 22 stored in a bottom portion of the compressor. Discharge ports 36*a* are formed in a discharge cover 36, and a reed-type discharge valve 11 is provided for opening and closing the discharge port 36*a*. A closed vessel 37 contains the compression element 33 and the electrically-operating element 2, and is provided with a suction pipe 38, a discharge pipe 39 and current-leading terminals 6.

Pin-type rotation prevention mechanisms 41 are provided at the orbiting piston 9 and the cylinder 34 to be disposed inwardly of compression working chambers 40. A suction cover 18 is mounted on a lower end surface of the cylinder 34, and forms a suction chamber 43 which is separated by this cover 18 from an electrically-operating element-side space (containing the electrically-operating element 2) in the closed vessel 37. A communication passage 45 communicating a discharge chamber 44 with the electrically-operating element 2 is formed in the discharge cover 36, the cylinder 34 and the suction cover 18. The electrically-operating element 2 comprises a stator 2*a* and a rotor 2*b*, and balancers 2*a* and 2*b*, respectively, are mounted on front and rear ends of the rotor 2*b* and the lower end portion 8*b* of the drive shaft 8, and under the influence of these balancers, an unbalance amount developing during the rotation is completely canceled. The principle of the operation of the pin-type rotation prevention mechanisms 41 is similar to that described above for FIG. 1, and therefore explanation thereof will be omitted.

A working fluid flows as indicated by arrows in FIG. 6, and more specifically the working fluid flowing into the closed vessel 37 through the suction pipe 38 flows into the compression element 37 via the suction chamber 20 formed by a suction port 34*c* and the suction cover 18 mounted on the cylinder 7, and when the drive shaft 35 is rotated by the electrically-operating element 2, the orbiting piston 9 revolves (that is, makes an orbital motion) through the eccentric portion 35*a*, so that the volume of the compression working chamber 40 is reduced, thereby effecting the compression operation. The compressed working fluid opens the discharge valve 11 via the discharge port 36*a* formed in the discharge cover 36 to be led to the discharge chamber 44, and flow through the communication passage 45 and the electrically-operating element-side space to be discharged from the discharge pipe 39 to the exterior of the compressor. At this time, the pin-type rotation prevention mechanisms 41 can completely avoid a rotating moment, acting on the orbiting piston 9.

The discharge pressure acts on the lubricating oil 22 stored in the bottom portion of the closed vessel 37, so that a centrifugal pumping action causes the lubricating oil 22 to be fed into an oil feed hole (not shown) formed in the drive shaft 35 to be supplied to the various sliding portions (in the main bearing portion 34*b* of the cylinder 34, the cylinder 34, the orbiting piston, and the pin-type rotation prevention mechanisms 41) via an oil feed hole 35*c* (communicating with the above oil feed hole) and an oil feed groove 35*d*. The lubricating oil 22 fed into the compression working chambers 40 via the various sliding portions merges into the working fluid, to flow from the discharge chamber 44 through the communicating passage 45, and cool the electrically-operating element 2, thus constituting an oil feed path, in which the fluid is separated from the working fluid, and is returned to the bottom portion of the closed vessel 37.

As a result, in this embodiment, the possibility of forming the drive shaft 35 in the cantilever support construction removes the need of an auxiliary bearing member, a balancer, an oil cover and so on, so that the displacement type compressor can be reduced in cost due to the reduction of the number of the component parts and improved in the productivity, and can be made compact, lightweight and low-cost.

Figure 7:
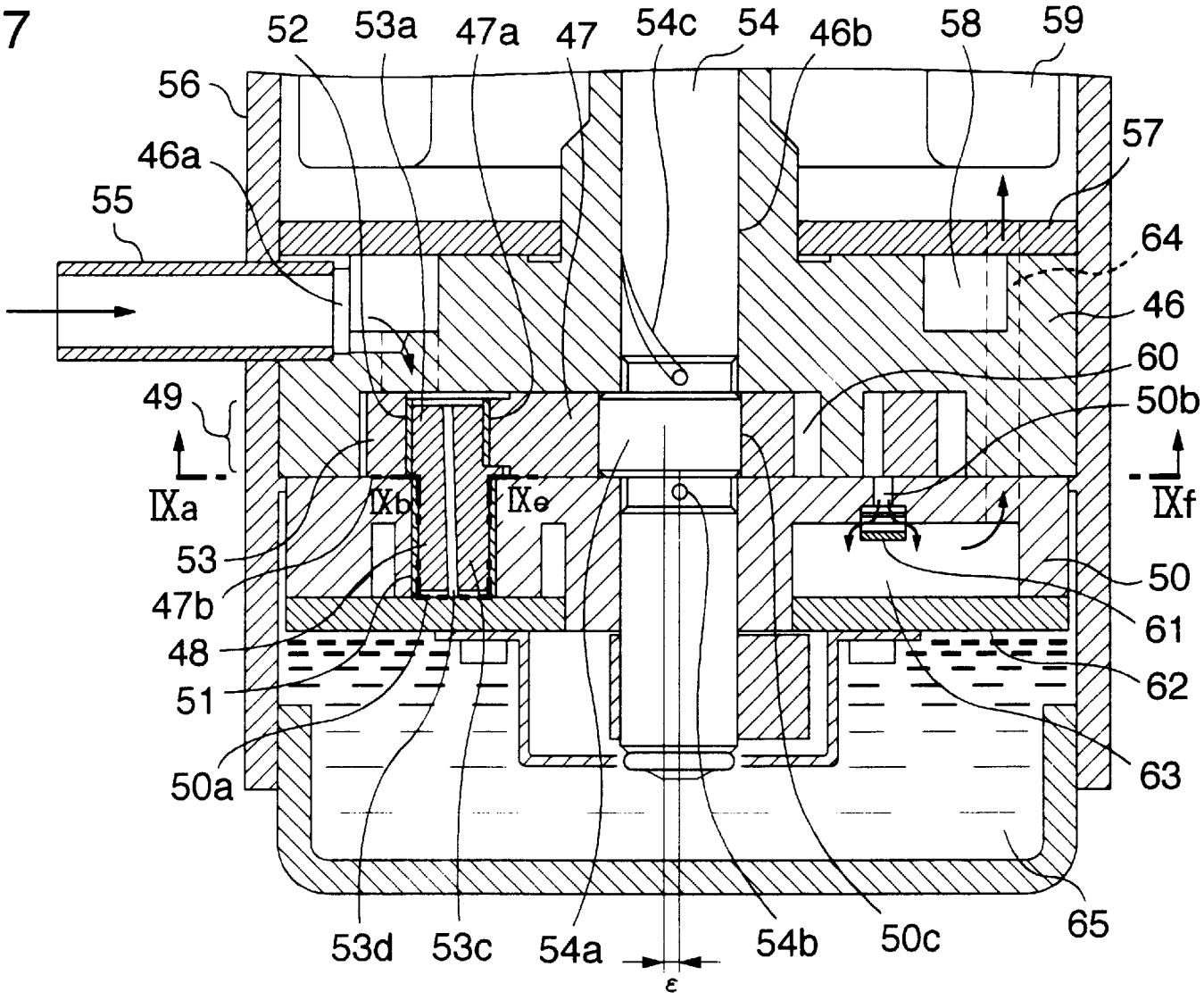
FIG. 7 is a vertical cross-sectional view showing a compression element according to an embodiment of the invention.

FIG. 7 is a vertical cross-sectional view showing a compression element 49 in which the configuration of an inner peripheral surface of a cylinder 46 as well as the configuration of an outer peripheral surface of an orbiting piston 47 is formed by four volute portions, and crank-type rotation prevention mechanisms 48 are provided.

This compression element 49 will now be described in detail with reference to FIGS. 9A to 9D. FIGS. 9A to 9D are views taken in directions of arrows IXa-IXb-IXc-IXd-IXe-IXf of FIG. 7. In these Figures, the character O denotes the center of the orbiting piston 47, and the character O' the center of the cylinder 46 and a drive shaft 54.

The configuration of the inner peripheral surface of the cylinder 46 is formed by combining four volute portions, each formed by a multi-arc-shaped curve, together in smoothly-continuous relation to one another. The configuration of the outer peripheral surface of the orbiting piston 47 is also formed according to the same principle as described for the cylinder 46, and this outer peripheral surface shape is similar to the shape or contour of the inner peripheral surface of the cylinder 46, and is smaller than it by an amount corresponding to the radius $\epsilon$ (=OO') of revolution (orbital motion).

An eccentric portion 54*a* of the drive shaft 54 is inserted in a bearing hole 47*c* in the orbiting piston 47, so that the orbiting piston 47 and the cylinder 46 are engaged with each other in such a manner that they are eccentric with respect to each other by an amount equal to the orbital radius $\epsilon$, thereby forming compression working chambers 60. The characters a, b, c, d, e, f, g and h denote points of contact (engagement) between the outer peripheral surface of the orbiting piston 47 and the inner peripheral surface of the cylinder 46.

For a compression operation, when the drive shaft 54 is rotated, the orbiting piston 47 revolves (i.e., makes an orbital motion) around the center O' of the fixed cylinder 46 with the orbital radius ϵ, so that the plurality of compression working chambers 60 are formed around the center of the orbiting piston 47.

Figure 9A:
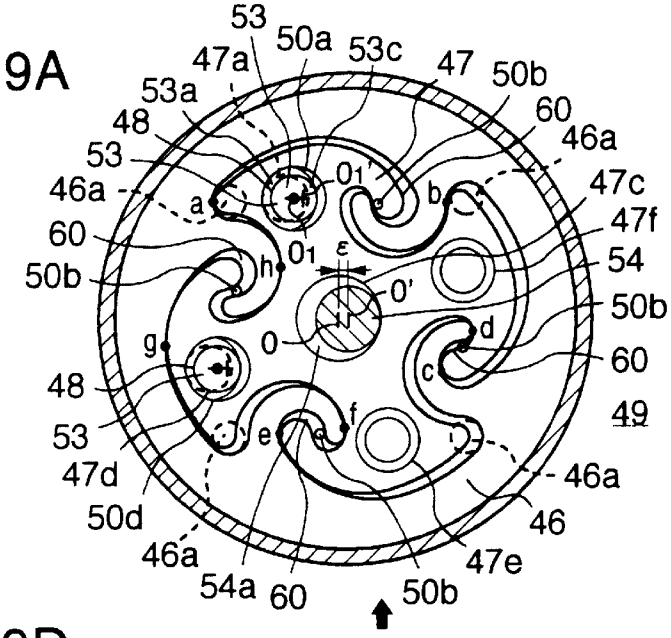
FIGS. 9A to 9D are plan views taken in directions of arrows IXa-IXb-IXc-IXd-IXe-IXf of FIG. 7, showing the principle of the operation of the compression element.
Figure 9B:
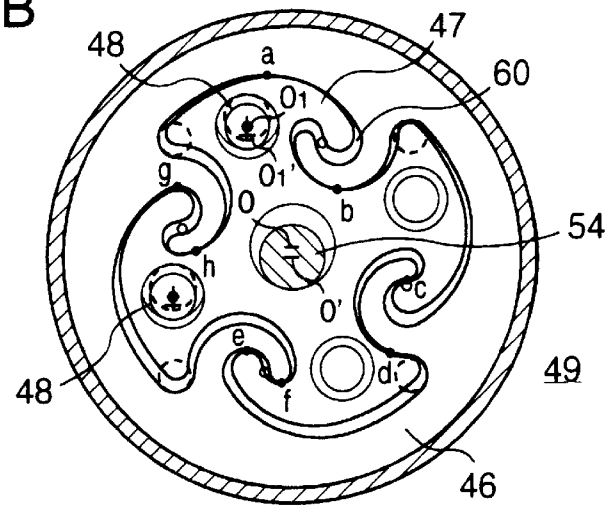
Figure 9C:
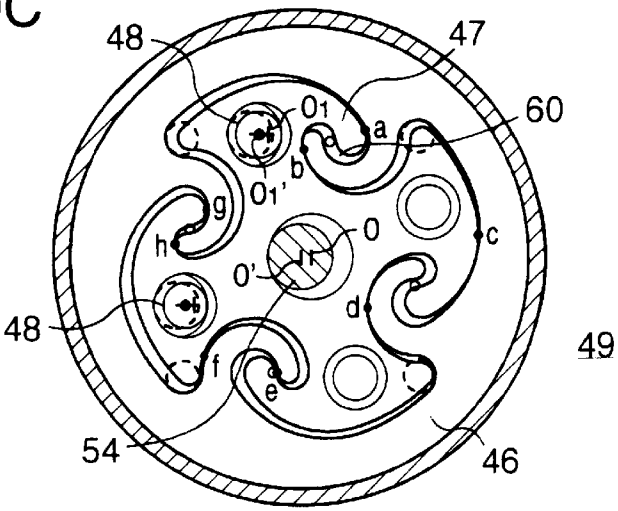
Figure 9D:
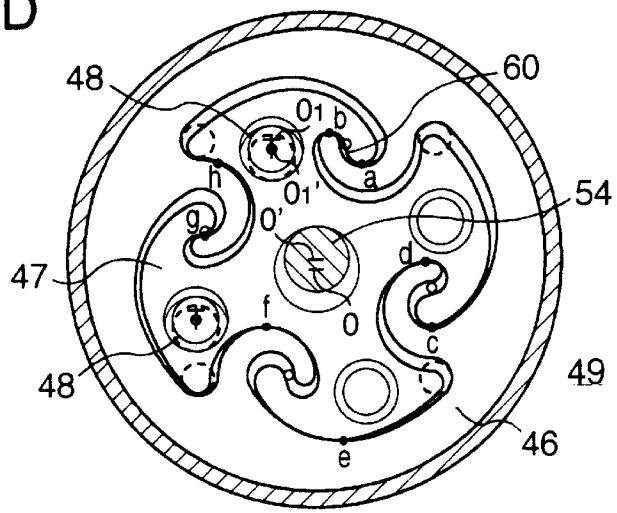

For the compression working chamber 60 formed between the contact point a and the contact point b (the chamber is divided into two compression working chambers, with a discharge port 50*b* interposed therebetween, at the time of the end of the suction stroke, but these two chambers are united into one chamber immediately when the compression stroke begins.), FIG. 9A shows a state in which the drawing of the working fluid into this compression working chamber 60 from a suction port 46*a* is finished, FIG. 9B showing a state resulted from rotating the drive shaft 54 clockwise through 90 degrees from this state, FIG. 9C showing a state resulted from rotating the drive shaft 54 clockwise through 90 degrees from the state of FIG. 9B, and FIG. 9D showing a state resulted from rotating the drive shaft 54 clockwise through 90 degrees from the state of FIG. 9C, and when the drive shaft 54 is further rotated clockwise through 90 degrees, the compression element is returned to the initial state of FIG. 9A.

Therefore, as the rotation of the drive shaft 54 proceeds, the volume of the compression chamber 60 is reduced and the discharge port 50*b* is closed by a discharge valve, so that the compression of the working fluid is effected.

Then, when the pressure within the compression working chamber 60 becomes higher than an outside discharge pressure (i.e., the pressure within a closed vessel), the discharge valve is automatically opened by the pressure difference, and the compressed working fluid is discharged through the discharge port 50*b*. The angle of rotation of the shaft from the end of the suction (the start of the compression) to the end of the discharge is 360 degrees, and while the compression and discharge strokes are effected, the next suction stroke is prepared, and when the discharge is finished, the next compression is started. Thus the compression working chambers 60 are disposed at equal intervals on a circle around the center O of the orbiting piston 47 to enable the compression operations to reduce a torque pulsation per rotation of the drive shaft 54, so that vibrations and noises in the displacement type compressor can be reduced.

In the embodiment shown in FIG. 4, discharging is effected three times during the rotation of 360 degrees while in the embodiment of FIG. 7, discharging is effected four times, and therefore the pulsating pressure at the discharge side can be made smaller in this embodiment.

Figure 8:
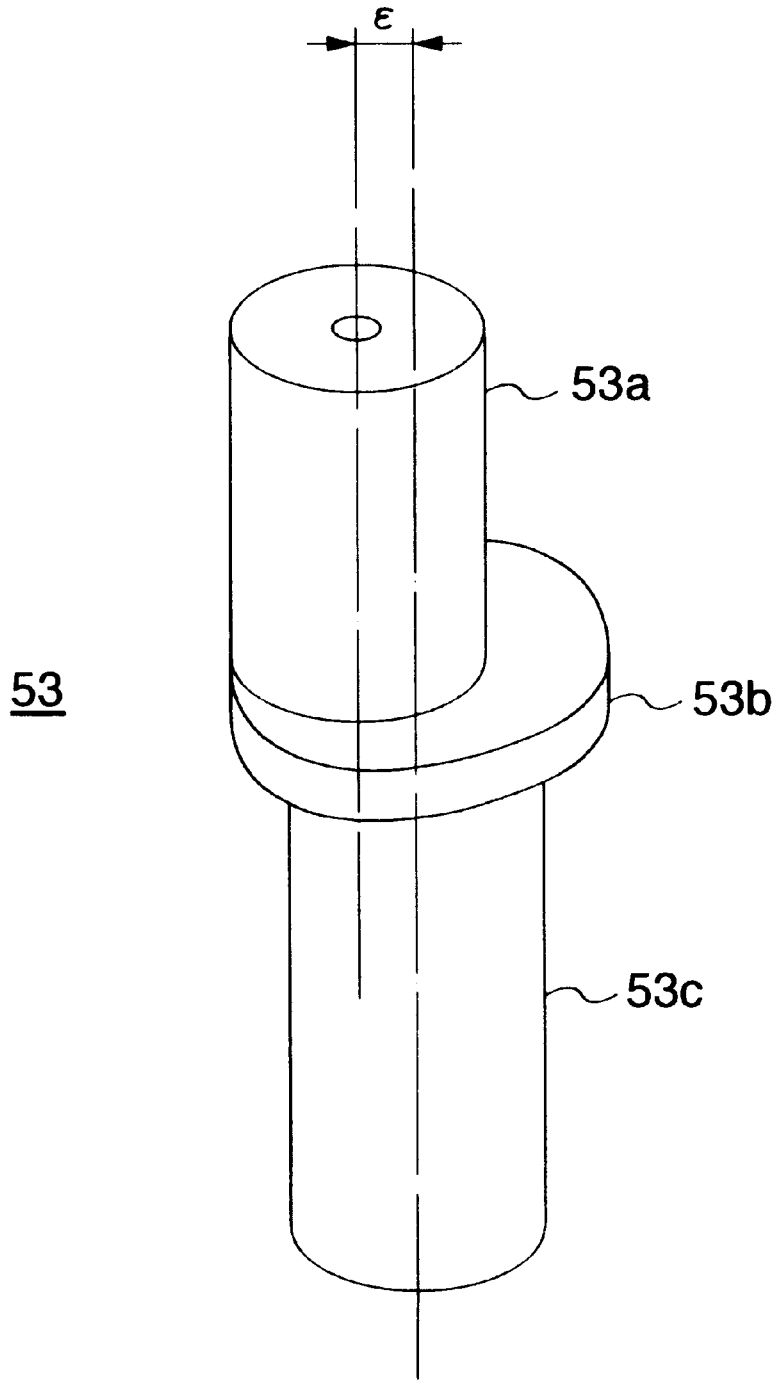
FIG. 8 is a view showing the appearance of a crank pin-type rotation prevention mechanism of the invention.

Next, the mechanism for preventing the orbiting piston 47 of the displacement type fluid machine of this construction from being rotated about its axis will be described. As shown in FIG. 8, a crank pin 53 of the rotation prevention mechanism 48 has an eccentric shaft portion 53*a*, a pedestal 53*b*, and a main shaft portion 53*c*. The distance between the center of the eccentric shaft portion 53*a* and the center of the main shaft portion 53*c* is equal to the orbital radius ϵ which is the distance between the center of the eccentric portion 54*a* of the drive shaft 54 and the center of the cylinder 46. An oil feed hole 53*d* is formed axially through the crank pin 53.

In FIG. 7, the main shaft portion 53*c* of the crank pin 53 is slidably fitted into a bearing member 51 fitted in a hole 50*a* in an auxiliary bearing member 50. The eccentric shaft portion 53*a* of the crank pin 53 is slidably fitted into a bearing member 52 fitted in a hole 47*a* in the orbiting piston 47. Grooves 47*b* are formed in the orbiting piston 47, and the pedestals 53*b* of the crank pins 53 are received in the grooves 47*b*, respectively. A lower surface of the pedestal 53*b* of the crank pin 53 and an end surface of the auxiliary bearing member 50 form sliding surfaces, respectively, which are in sliding contact with each other. The operation of this crank-type rotation prevention mechanism 48 will now be described with reference to FIGS. 9A to 9D.

Four holes 47*a*, 47*d*, 47*e* and 47*f* are formed in the orbiting piston 47 to be disposed at equal intervals around the center O. The bearing members 52 having excellent sliding properties are fitted in these holes, respectively. The eccentric shaft portions 53*a* of the crank pins 53 are slidably fitted respectively in at least two (47*a* and 47*d*) of these holes (only with the eccentric portion 54*a* of the drive shaft 54 and one crank pin 53, there is a possibility of reverse rotation in view of the principle of a crank, and therefore at least two holes are necessary. In view of the overall balance of the orbital motion, it is preferred to provide the crank pins 53 in the four holes, respectively.). The main shaft portions 53*c* of the crank pins 53, respectively, are slidably fitted in the bearing members 51 (having excellent sliding properties) press-fitted respectively in the corresponding ones of the holes 50*a* which are formed in the same direction as the orbital radius ϵ, and are disposed at equal intervals around the center O' of the auxiliary bearing member 50. Namely, the distance between the center O1 of the eccentric shaft portion 53*a* of the crank pin 53 and the center O1' of the main shaft portion 53*c* of the crank pin 53 is equal to the orbital radius ϵ which is the distance between the center O of the orbiting piston 47 and the center O' of the cylinder 46.

The eccentric shaft portions 53*a* (slidably fitted respectively in the holes 47*a* and 47*d* in the orbiting piston 47) of the crank pins 53 of the rotation prevention members 48 make an orbital motion, relatively equal to that of the center of the orbiting piston 47, about the centers O1' of the respective main shaft portions 53*c* (slidably fitted respectively in the holes 50*a* and 50*d* in the fixed auxiliary bearing member 50) with the distance (=orbital radius ϵ) between the center O of the orbiting piston 47 and the center O' of the cylinder 46 in the sequence of FIGS. 9A, 9B, 9C, 9D and 9A. The pedestal 52 of each crank pin 53 is received in the associated groove 47*b* formed in the orbiting piston 47, and makes a sliding movement relative to the end surface of the auxiliary bearing member 50.

By preventing the rotation of the orbiting piston 47 by the crank pins, a rotating moment, developing when compressing the working fluid, can be suppressed, and therefore an excess sliding movement will not occur between the orbiting piston 47 and the cylinder 46, thereby preventing wear. Therefore, the minimum gap between the orbiting piston 47 and the cylinder 46 can be maintained.

Next, the flow of the working fluid will be described. As indicated by arrows in FIG. 7, the working fluid entering into the closed vessel 56 through a suction pipe 55 flows into the compression element 49 via a suction chamber 58 formed by a suction port 46*a* and a suction cover 57 mounted on the cylinder 46, and when the drive shaft 54 is rotated by an electrically-operating element 59, the orbiting piston 47 revolves (that is, makes an orbital motion) through the eccentric portion 54*a*, so that the volume of the compression working chamber 60 is reduced, thereby effecting the compression operation. The compressed working fluid opens the discharge valve 61 via the discharge port 50*b* formed in the auxiliary bearing member 50 to be led to a discharge chamber 63 formed by a discharge cover 62 secured to the lower side of the auxiliary bearing member 50 to flow through a communication passage 64 and the electrically-operating element 59, and then it is discharged from a discharge pipe (not shown) to the exterior of the compressor.

The discharge pressure acts on lubricating oil 65 stored in the bottom portion of the closed vessel 56, and therefore by a centrifugal pumping action, the lubricating oil 65 is fed into an oil feed hole (not shown) formed in the drive shaft 54 to be supplied to the various sliding portions (in a main bearing portion 46*b* of the cylinder 46, an auxiliary bearing portion 50*c* of the auxiliary bearing member 50, the cylinder 46, the orbiting piston 47, and the crank-type rotation prevention mechanisms 48) via an oil feed hole 54*b* (communicating with the above oil feed hole) and an oil feed groove 54*c*. The lubricating oil 65 fed into the compression working chambers 60 via the various sliding portions merges into the working fluid to flow from the discharge chamber 63 through the communicating passage 64 to cool the electrically-operating element 59, and then it is separated from the working fluid to be returned to the bottom portion of the closed vessel 56. Thus, the lubricating oil flows along this oil feed path.

In the above embodiment of FIG. 7, the provision of the crank-type rotation prevention mechanisms 48 can impart a positive orbital motion to the orbiting piston 47. Also, a gap at the point of contact between the orbiting piston 47 and the cylinder 46, which forms the compression working chambers 60, can be kept constant to reduce the friction and wear, so that the displacement type fluid machine of a high reliability can be provided. Besides, the crank-type rotation prevention mechanisms 48 can be disposed inwardly of the compression working chambers 60 to make the compression element 49 smaller in diameter. Furthermore, the number of the component parts of the crank-type rotation prevention mechanism 48 is small to enable reducing the cost, and easily control the precision of the parts, so that the rotation prevention mechanism of a high precision can be provided.

In the compression element 49 of this embodiment, the compression working chambers 60, in which the angle of rotation of the shaft from the end of the suction to the end of the discharge is 360 degrees, are distributed at equal intervals around the eccentric portion 54*a* of the drive shaft 54, so that the operating point of the rotating moment can be disposed nearer to the center of the orbiting ton 47 and the rotating moment acting on the orbiting piston 47 is small.

In the compression element 49 of this embodiment, the compression stroke is finished in a short time to reduce the leakage of the working fluid, and enhance the ability and efficiency of the displacement type compressor.

On the other hand, the discharge stroke is longer than that in a conventional rolling-type machine to decrease the flow velocity of the working fluid at the time of the discharge, so that a pressure loss is reduced, and a fluid loss (excess compression loss) during the discharge is greatly reduced, thereby enhancing the performance of the displacement type compressor. Besides, the compression element 49 of this embodiment reduces a variation in torque to achieve the low-vibration, low-noise design. Furthermore, there is no need to use volute configurations and end plates as in a scroll-type machine, so that the time required for processing or working the parts, as well as the cost, can be reduced, and since a thrust load does not act on the above end plate, the axial gap, which determines the performance of the displacement type compressor, can be easily controlled to enhance the performance.

The inner peripheral surface of the cylinder 46 and the outer peripheral surface of the orbiting piston 47 are similar in shape to each other to be spaced a distance of the radial radius $\epsilon$ from each other. Therefore, the two members can be produced from the same material in one step, so that such a production line can enhance the productivity, and provide the cylinder 46 and the orbiting piston 47, having a good conformability between their mating surfaces (i.e., the inner peripheral surface of the cylinder 46 and the outer peripheral surface of the orbiting piston 47).

A coating treatment of excellent sliding properties on at least one of the outer peripheral surface of the orbiting piston 47 and the inner peripheral surface of the cylinder 46 can control the gap between the two members at an initial stage of the operation of the displacement type compressor to prevent the performance.

Figure 10:
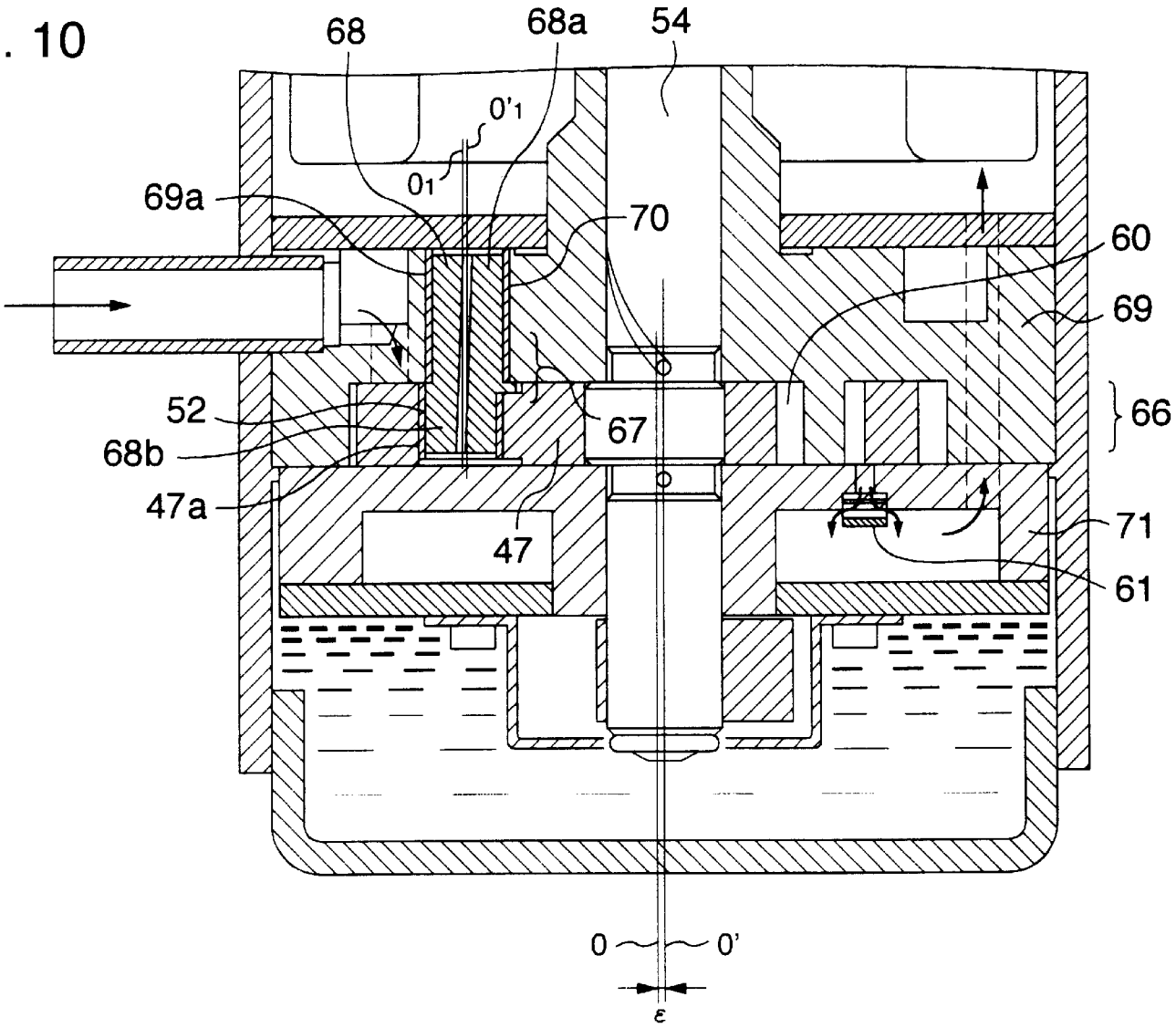
FIG. 10 is a vertical cross-sectional view showing a compression element of the invention.

FIG. 10 is a vertical cross-sectional view showing a compression element 66 of the present invention. In this embodiment, the arrangement of crank-type rotation prevention mechanisms 67 is different from that of FIG. 7, and this different portion will be mainly described.

Main bearing portions 68*a* of crank pins 68 of the crank-type rotation prevention mechanisms 67 are slidably supported through bearing members 70 fitted in holes 69*a* which are formed in a cylinder 69 to be disposed at equal intervals around the center of the cylinder 69. An eccentric shaft portion 68*b* of the crank pin 68 is slidably inserted into a bearing member 52 provided in a hole 47*a* in an orbiting piston 47.

In this regard, the distance between the center O1' of the main shaft portion 68*a* of the crank pin 68 and the center O1 of the eccentric shaft portion 68*b* is equal to an orbital radius $\epsilon$ which is the distance between the center O' of a drive shaft 54 and the center O of the orbiting piston 47. The principle of the operation of the crank-type rotation prevention mechanisms 67, as well as the flow of a working fluid, is similar to that described above for FIG. 7, and therefore explanation thereof will be omitted.

As a result, in the embodiment of FIG. 10, similar effects as described for FIG. 7 can be obtained, and a rotating moment tending to rotate the orbiting piston 47 by the internal pressure of compression working chambers 60 produced when the working fluid is compressed is completely avoided, and a positive orbital motion can be imparted to the orbiting piston 47. Besides, a gap at the point of contact between the orbiting piston 47 and the cylinder 69 can be kept constant to reduce the friction and wear, so that the displacement type compressor of a high reliability can be provided. Furthermore, an auxiliary bearing member 71, having discharge valves 61, can be simplified in shape to lead to cost reduction.

Figure 11:
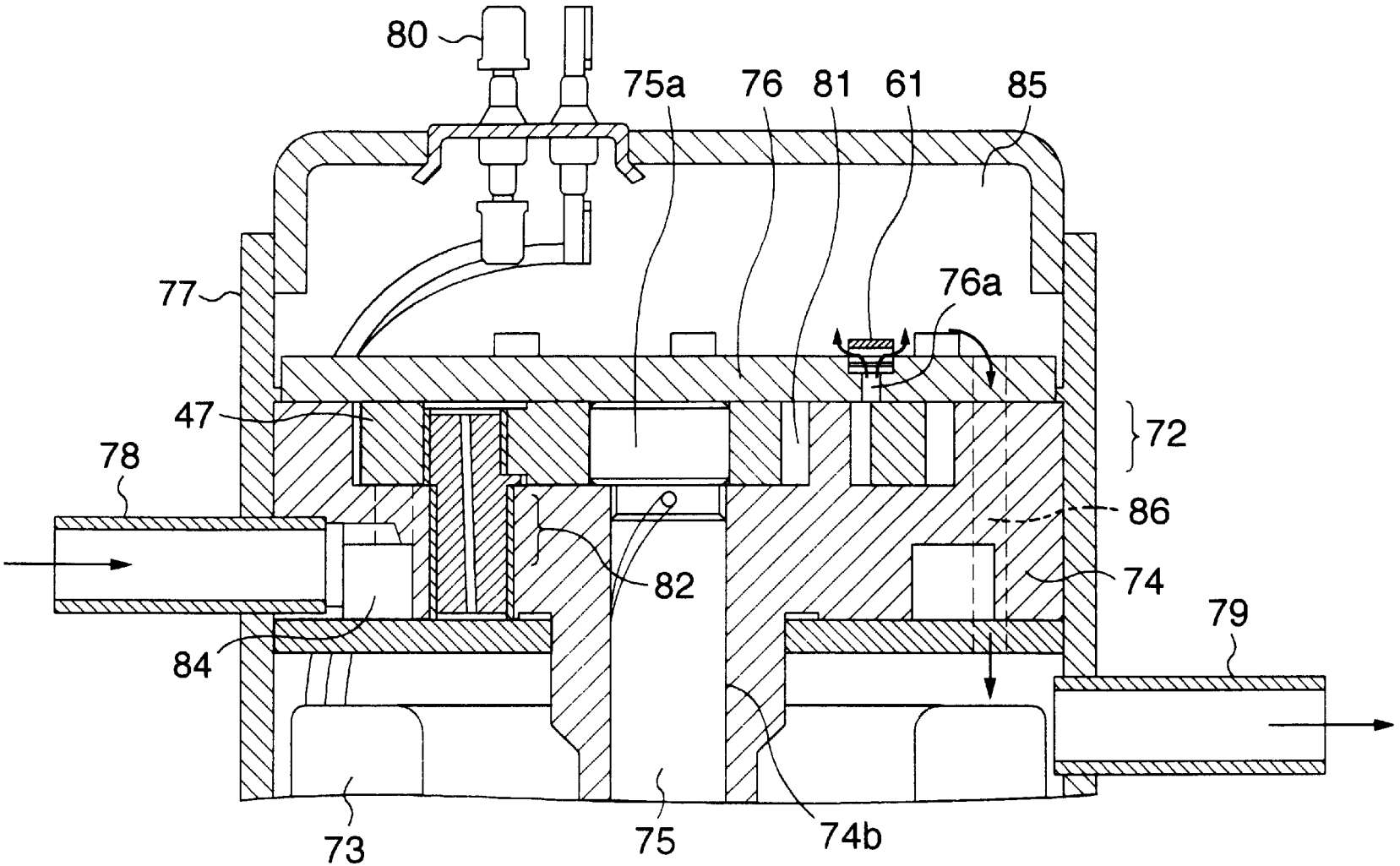
FIG. 11 is a vertical cross-sectional view showing a compression element of the invention.

FIG. 11 is a vertical cross-sectional view showing a compression element 72 of the present invention. In this embodiment, the arrangement of the compression element 72 is different from that of FIG. 7, and this different portion will be mainly described.

In FIG. 11, the compression element 72 of the invention is disposed above an electrically-operating element 73 for driving this compression element 72. An orbiting piston 47 of the compression element 72 is engaged with vanes 74*a* of a cylinder 74, and is provided at its central portion with a bearing hole 47*a*, which is fitted on an eccentric portion 75*a* of a drive shaft 75. The drive shaft 75 is borne by a main bearing portion 74*b* formed at the cylinder 74 to support the orbiting piston 47, fitted on the eccentric portion 75*a*, in a cantilever manner.

Discharge ports 76*a* are formed in a discharge cover 76, and a reed-type discharge valve 61 is provided for opening and closing the discharge port 76*a*. Crank-type rotation prevention mechanisms 82 are provided in the orbiting piston 47 and the cylinder 74 to be disposed inwardly of compression working chambers 81. A suction cover 83 is mounted on a lower end surface of the cylinder 74 to form a suction chamber 84 which is separated by this cover 83 from an electrically-operating element-side space (containing the electrically-operating element 73) in a closed vessel 77. A communication passage 86 communicating a discharge chamber 85 with the electrically-operating element-side space is formed in the discharge cover 76, the cylinder 74 and the suction cover 83. The principle of the operation of the crank-type rotation prevention mechanisms 82 is similar to that described above for FIG. 7, and therefore explanation thereof will be omitted.

As indicated by arrows in FIG. 11, a working fluid entering into the closed vessel 77 through a suction pipe 78 flows into the compression element 72 via the suction chamber 84 formed by a suction port 74*c* and the suction cover 83 mounted on the cylinder 74, and when the drive shaft 75 is rotated by the electrically-operating element 73, the orbiting piston 47 makes an orbital motion through the eccentric portion 75*a*, so that the volume of the compression working chamber 81 is reduced, thereby effecting the compression operation. The compressed working fluid opens the discharge valve 61 via the discharge port 76*a* formed in the discharge cover 76 to be led to the discharge chamber 85 to pass through the communication passage 86 and the electrically-operating element-side space to be discharged from a discharge pipe 79 to the exterior of the compressor. At this time, the action of the crank-type rotation prevention mechanisms 82 can completely avoid a rotating moment acting on the orbiting piston 47.

As a result, in the embodiment of FIG. 11, since the drive shaft 75 is of the cantilever support construction, an auxiliary bearing member, a balancer, an oil cover and so on can be dispensed with, which achieves cost reduction due to the reduction of the number of the component parts of the displacement type compressor, enhancement of productivity, and a compact, lightweight design.

Figure 12:
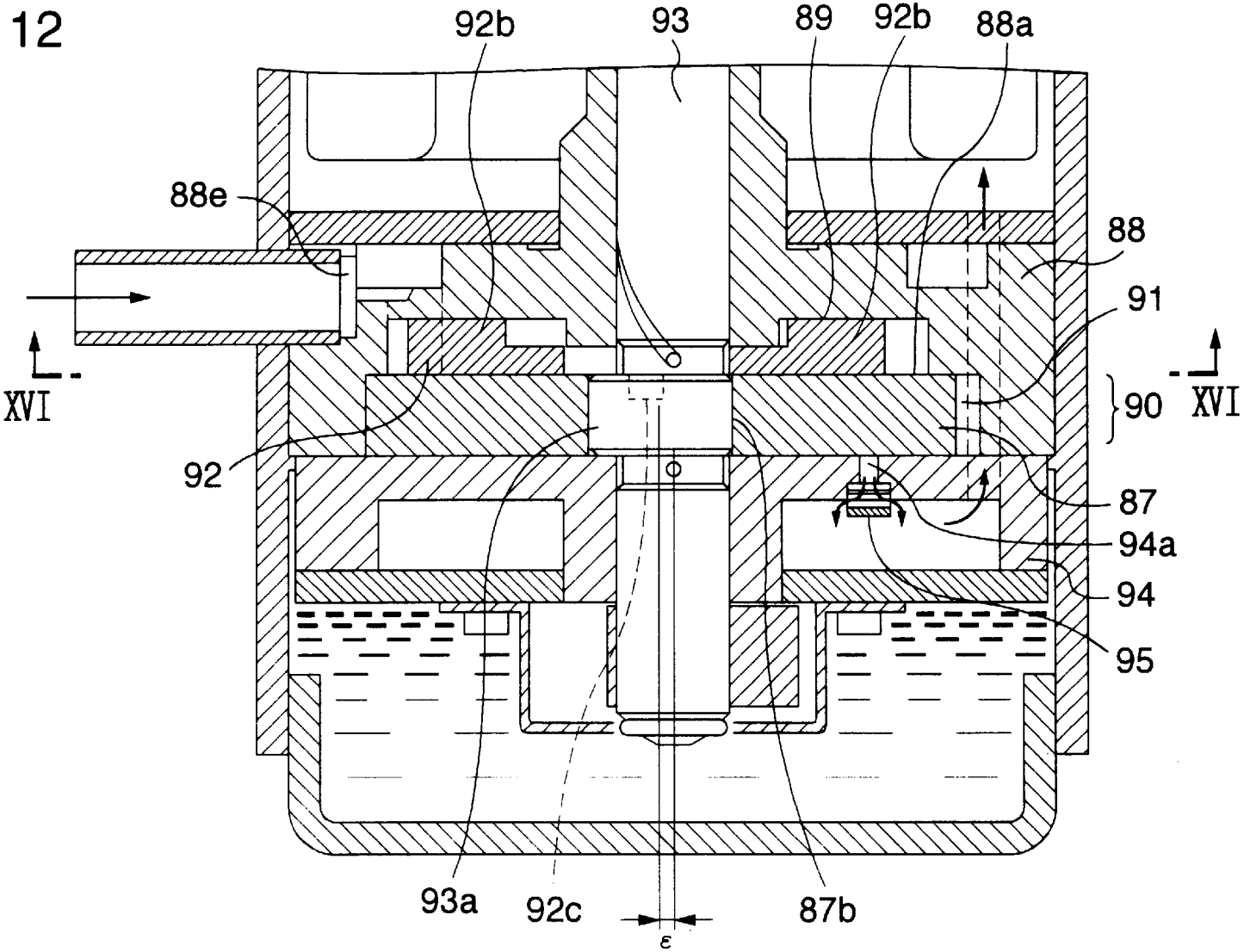
FIG. 12 is a vertical cross-sectional view showing a compression element of the invention.

FIG. 12 is a vertical cross-sectional view showing a compression element 90 in which the configuration of an outer peripheral surface of an orbiting piston 87 as well as the configuration of an inner peripheral surface of a cylinder 88 is formed by four volute portions, and an Oldham key-type rotation prevention mechanism 89 is used. The Oldham key-type rotation prevention mechanism 89 is disposed inwardly of compression working chambers 91 formed by the orbiting piston 87 and the cylinder 88.

Figure 13:
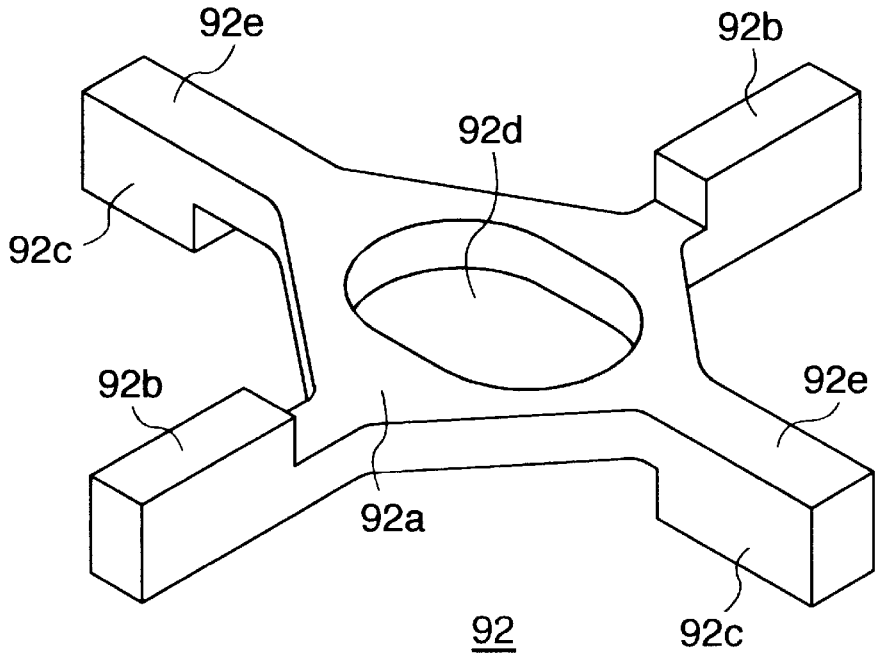
FIG. 13 is a view showing an appearance of an Oldham key-type rotation prevention mechanism of the invention.

FIG. 13 is a view showing the appearance of an Oldham key 92 constituting the Oldham key-type rotation prevention mechanism 89. Two notch portions 92*b* are formed on an upper side of a pedestal 92*a* of the Oldham key 92 while two notch portions 92*c* are formed on a lower side of the pedestal 92*a*, and the notch portions 92*b* are perpendicular to the notch portions 92*c*, and these notch portions 92*b* and 92*c* are disposed 90 degrees out of phase with one another. A hole 92*d*, through which a drive shaft 93 is passed, is formed through a central portion of the Oldham key 92.

Figure 14:
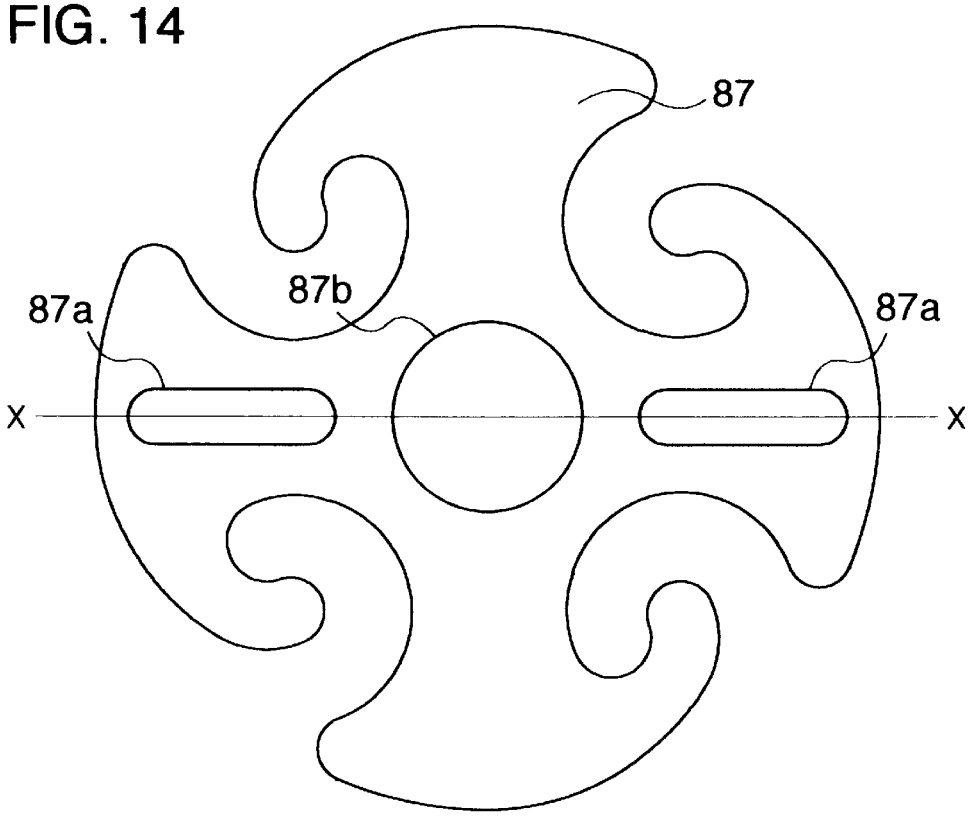
FIG. 14 is a view showing an appearance of an orbiting piston of the invention.

As shown in FIG. 14, two grooves 87*a* are formed in an end surface of the orbiting piston 87, and the notch portions 92*c* of the Oldham key 92, respectively, are received in these grooves 87*a* for smooth sliding movement therealong. The length of the grooves 87*a* in an X-axis direction is so determined that the notch portions 92*c* can reciprocally move in the X-axis direction. The width and depth of the grooves 87*a* are so determined that the notch portions 92*c* of the Oldham key 92 can smoothly slide.

Figure 15:
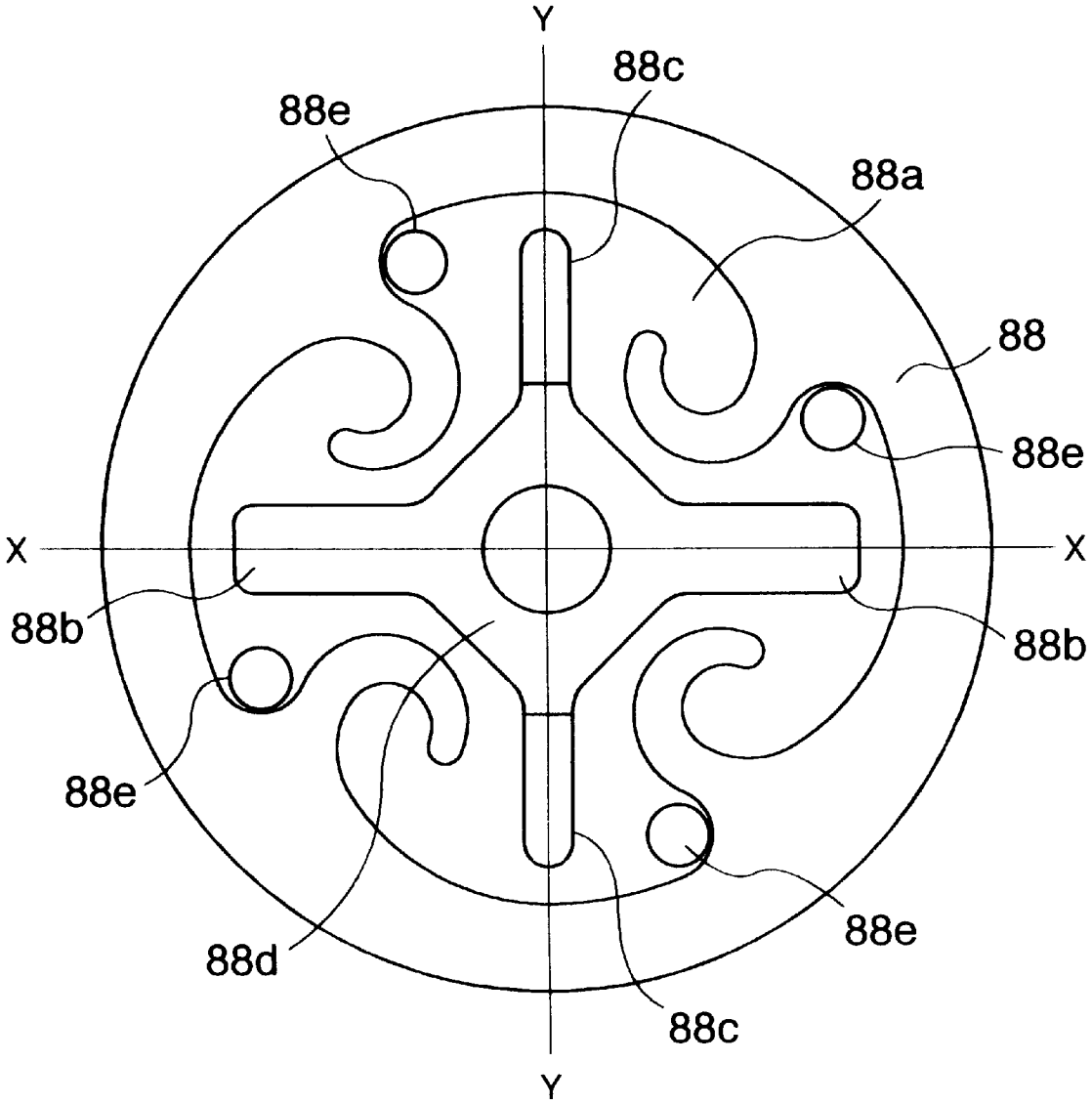
FIG. 15 is a view showing an appearance of a cylinder of the invention.

FIG. 15 is a schematic view of the cylinder 88 as viewed from the bottom side of the compressor. Grooves 88*b* extending in the X-axis direction, grooves 88*c* extending in a Y-axis direction, and a groove 88*d* are formed in a bottom surface 88*a* of the cylinder 88, against which the upper end of the orbiting piston 87 abuts. Flat surface portions 92*e* of the Oldham key 92, respectively, are received in the grooves 88*b* for smooth sliding movement therealong, and the notch portions 92*b* of the Oldham key 92, respectively, are received in the grooves 88*c* for smooth sliding movement therealong, and the pedestal 92*a* of the Oldham key 92 is held in smooth sliding contact with the groove 88*d*.

The length of the grooves 88*b* in the X-axis direction is so determined that the flat surface portions 92*e* of the Oldham key 92 can reciprocally move in the X-axis direction. The length of the grooves 88*b* in the Y-axis direction is so determined that the flat surface portions 92*e* of the Oldham key 92 can reciprocally move in the Y-axis direction. The depth of the grooves 88*b* is so determined that the flat surface portions 92*e* of the Oldham key 92 can smoothly slide.

The length of the grooves 88*c* in the Y-axis is so determined that the notch portions 92*b* of the Oldham key 92 can reciprocally move in the Y-axis direction. The width and depth of the grooves 88*c* are so determined that the notch portions 92*b* of the Oldham key 92 can smoothly slide.

Figures 16A, 16B, 16C, 16D:
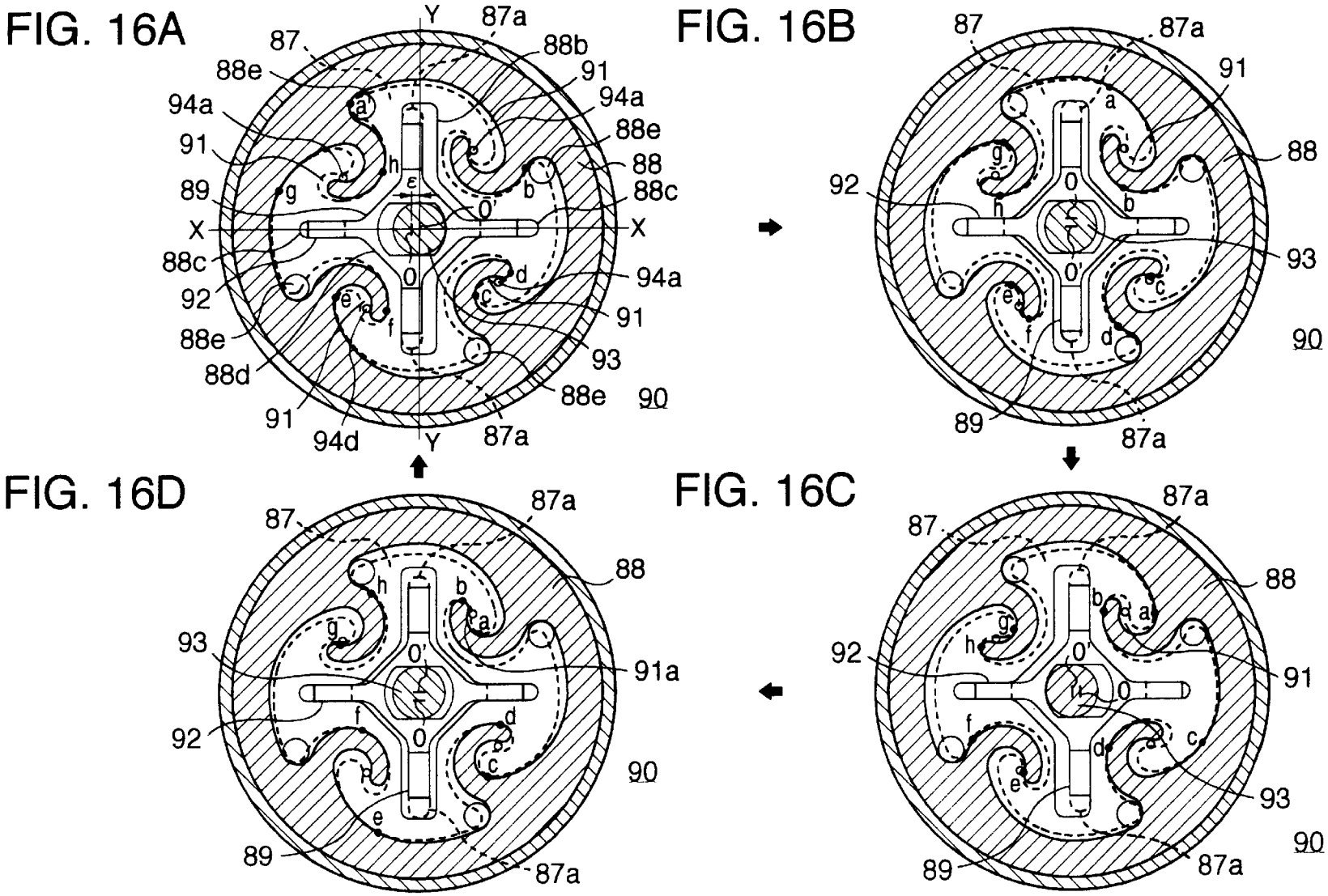
FIGS. 16A to 16D are plan views taken along the line XVI—XVI of FIG. 12, showing the principle of the operation of the compression element.

Next, the operation of the compression element 90 and the operation of the Oldham key-type rotation prevention mechanism 89 will be described with reference to FIG. 16. FIGS. 16A to 16D are views taken along the line XVI—XVI of FIG. 12. In these Figures, the character O denotes the center of the orbiting piston 87 (shown this side in the drawing, and indicated by a broken line), and the character O' denotes the center of the cylinder 88 and the drive shaft 93. The configuration of the inner peripheral surface of the cylinder 88 is formed by combining four volute portions, each formed by a multi-arc-shaped curve, together in smoothly-continuous relation to one another.

The configuration of the outer peripheral surface of the orbiting piston 87 is also formed according to the same principle as described for the cylinder 88. This outer peripheral surface shape is similar to the shape or contour of the inner peripheral surface of the cylinder 88, and is smaller than it by an amount corresponding to a radius $\epsilon$ (=OO') of revolution (orbital motion). The characters a, b, c, d, e, f, g and h denote points of contact (engagement) between the outer peripheral surface of the orbiting piston 87 and the inner peripheral surface of the cylinder 88 which form the compression working chambers.

The orbiting piston 87, when fitted on an eccentric portion (not shown) of the drive shaft 93, is engaged with the cylinder 88 in such a manner that they are eccentric with respect to each other by an amount equal to the orbital radius $\epsilon$. At this time, the Oldham key 92 constituting the rotation prevention mechanism 89, is slidably disposed between the grooves 87*a* formed in the end surface of the orbiting piston 87, and the grooves 88*b* and 88*c* and the flat surface portion 88*d* formed in the bottom surface 88*a* of the cylinder 88. The shapes and dimensions of the grooves 87*a*, 88*b* and 88*c* and flat surface portion 88*d* are so determined that the notch portions 92*b* and 92*c*, respectively, formed on the upper and lower sides of the Oldham key 92 can reciprocally move a distance corresponding to the orbital radius $\epsilon$, so that the position of the Oldham key 92 is determined in accordance with the position of engagement of the orbiting piston 87 with the cylinder 88.

A compression operation will now be described. For the compression working chamber 91 formed between the contact point a and the contact point b in FIGS. 16A to 16D (the chamber is divided into two compression working chambers, with a discharge port 94*a* interposed therebetween, at the time of the end of the suction stroke, but these two chambers are combined into one chamber immediately when the compression stroke begins.), FIG. 16A shows a state in which the drawing of a working fluid into this compression working chamber 91 from a suction port 88*e* is finished, FIG. 16B showing a state resulted from rotating the drive shaft 93 clockwise through 90 degrees from this state, FIG. 16C showing a state resulted from rotating the drive shaft 93 clockwise through 90 degrees from the state of FIG. 16B, and FIG. 16D showing a state resulted from rotating the drive shaft 93 clockwise through 90 degrees from the state of FIG. 16C, and when the drive shaft 93 is further rotated clockwise through 90 degrees, the compression element is returned to the initial state of FIG. 16A. Therefore, as the rotation of the drive shaft 93 proceeds, the volume of the compression chamber 91 is reduced, and since the discharge port 94*a* formed in an auxiliary bearing member 94 is closed by a discharge valve 95, the compression of the working fluid is effected.

At this time, the notch portions 92*b* of the Oldham key 92 constituting the rotation prevention mechanism 89 reciprocally move in the X-axis direction relative to the cylinder 88 with an amplitude equal to the orbital radius $\epsilon$ whereas the notch portions 92*c* of the Oldham key 92 engaged with the orbiting piston 87 reciprocally move on the orbiting piston 87 with the same amplitude in the Y-axis direction perpendicular to the X-axis direction, which is 90 degrees out of phase with the X-axis direction. Therefore, the orbiting piston 87 makes a revolution (orbital motion), composed of these reciprocal motions, relative to the cylinder 88, and its orbit (path of travel) is equal to that of the center of the orbiting piston 87.

Therefore, the provision of the Oldham key-type rotation prevention mechanism 89 causes the orbiting piston 87 to make an orbital motion around the center of the fixed cylinder 88 with the orbital radius $\epsilon$ without rotation while kept in the same posture. The plurality of compression working chambers 91 formed around the center of the orbiting piston 87 continuously effect the suction, compression and discharge strokes in a phase-shifting manner.

As a result, in the embodiment of FIG. 11, a rotating moment tending to rotate the orbiting piston 87 by the internal pressure of the compression working chambers 91 produced when the working fluid is compressed is completely avoided, and a positive orbital motion can be imparted to the orbiting piston 87. Besides, a gap at the point of contact in the compression working chambers between the orbiting piston 87 and the cylinder 88 can be kept constant to reduce the friction and wear, so that the displacement type compressor of a high reliability can be provided. Furthermore, the Oldham key-type rotation prevention mechanism 89 can be disposed inwardly of the compression working chambers 91 to make the compression element 90 smaller in diameter. Further, the number of the component parts of the Oldham key-type rotation prevention mechanism 89 is small to reduce the cost, and easily control the precision of the parts, so that the rotation prevention mechanism 89 of a high precision can be provided.

Figure 17:
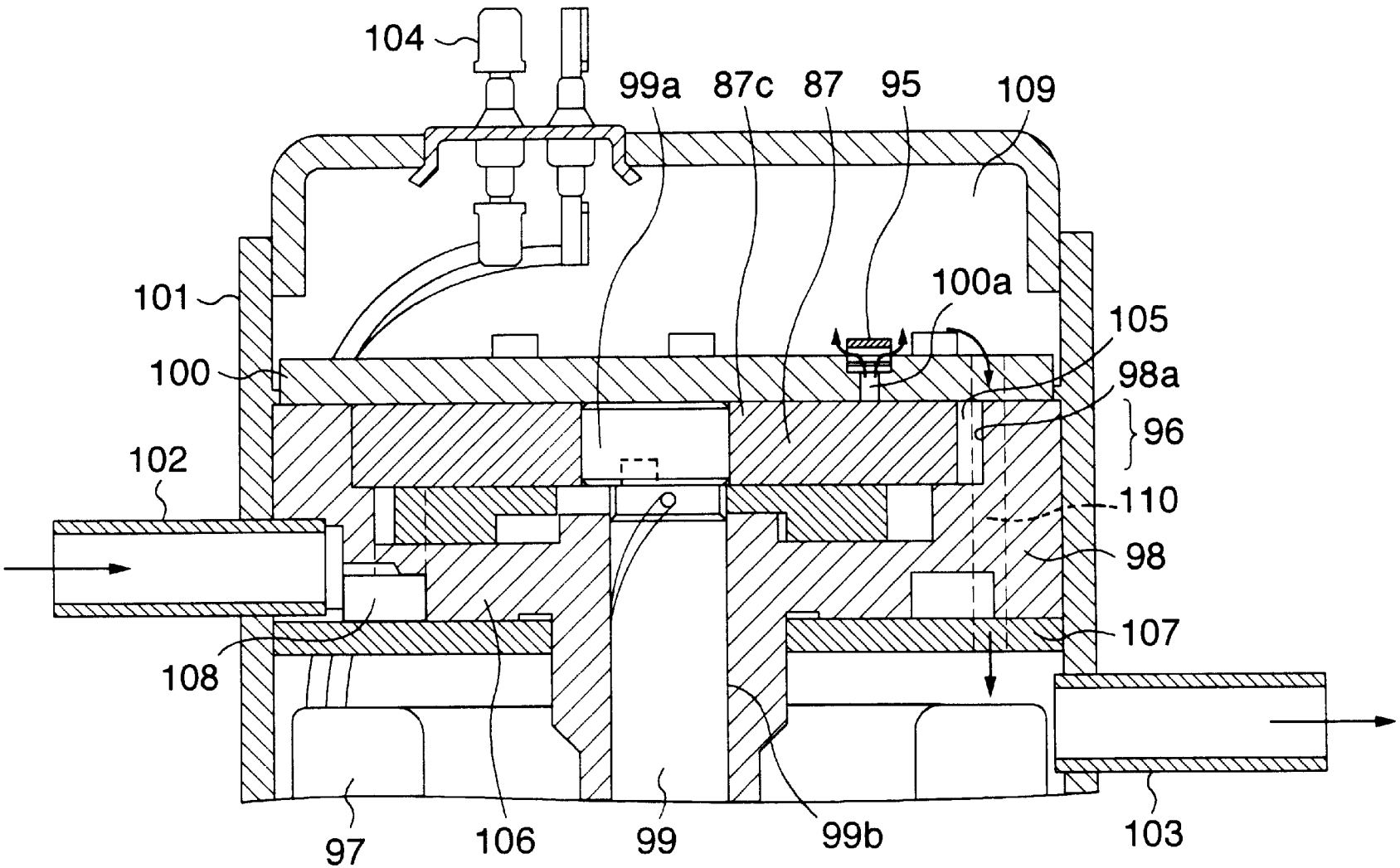
FIG. 17 is a vertical cross-sectional view showing a compression element of the invention.

FIG. 17 is a vertical cross-sectional view showing a displacement type compressor of the present invention. In this embodiment, the arrangement of a compression element 96 is different from that of FIG. 12, and this different portion will be mainly described.

In FIG. 17, the compression element 96 of the invention is disposed above an electrically-operating element 97 for driving this compression element 96. An orbiting piston 87 of the compression element 96 is engaged with vanes 98*a* of a cylinder 98, and is provided at its central portion with a bearing hole 87*c* which is fitted on an eccentric portion 99*a* of a drive shaft 99. The drive shaft 99 is borne by a main bearing portion 98*b* formed at the cylinder 98 to support the orbiting piston 87, fitted on the eccentric portion 99*a*, in a cantilever manner. Discharge ports 100*a* are formed in a discharge cover 100, and a reed-type discharge valve 95 is provided for opening and closing the discharge port 100*a*. An Oldham key-type rotation prevention mechanism 106 is provided between end surfaces of the orbiting piston 87 and the cylinder 98 to be disposed inwardly of compression working chambers 105. A suction cover 107 is mounted on the lower end surface of the cylinder 98 to form a suction chamber 108 which is separated by this cover 107 from an electrically-operating element-side space (containing the electrically-operating element 97) in a closed vessel 101. A communication passage 110 communicating a discharge chamber 109 with the electrically-operating element-side space is formed in the discharge cover 100, the cylinder 98 and the suction cover 107. The principle of the operation of the Oldham key-type rotation prevention mechanism 106 is similar to that described above for FIGS. 16A to 16D, and therefore explanation thereof will be omitted.

As indicated by arrows in FIG. 17, a working fluid entering into the closed vessel 101 through a suction pipe 102 flows into the compression element 96 via the suction chamber 108 formed by a suction port 98*a* and the suction cover 107 mounted on the cylinder 98, and when the drive shaft 99 is rotated, the orbiting piston 87 fitted on the eccentric portion 99*a* of the drive shaft 99 revolves (that is, makes an orbital motion), so that the volume of the compression working chamber 105 is reduced, thereby effecting the compression operation. The compressed working fluid opens the discharge valve 95 via the discharge port 10*a* formed in the discharge cover 100 to flow into the discharge chamber 109 to pass through the communication passage 110 and the electrically-operating element-side space, and then it is discharged from a discharge pipe 103 to the exterior of the compressor. At this time, the Oldham key-type rotation prevention mechanism 106 can completely avoid a rotating moment acting on the orbiting piston 87. A path of lubricating oil in this embodiment is similar to that shown in FIG. 12, and therefore explanation thereof will be omitted.

As a result, in the embodiment of FIG. 17, the drive shaft 99 of the cantilever support construction dispenses with an auxiliary bearing member, a balancer, an oil cover and so on to enable achieving cost reduction due to the reduction of the number of the component parts of the displacement type compressor, enhancement of the productivity, and the compact, lightweight design.

Figure 18:
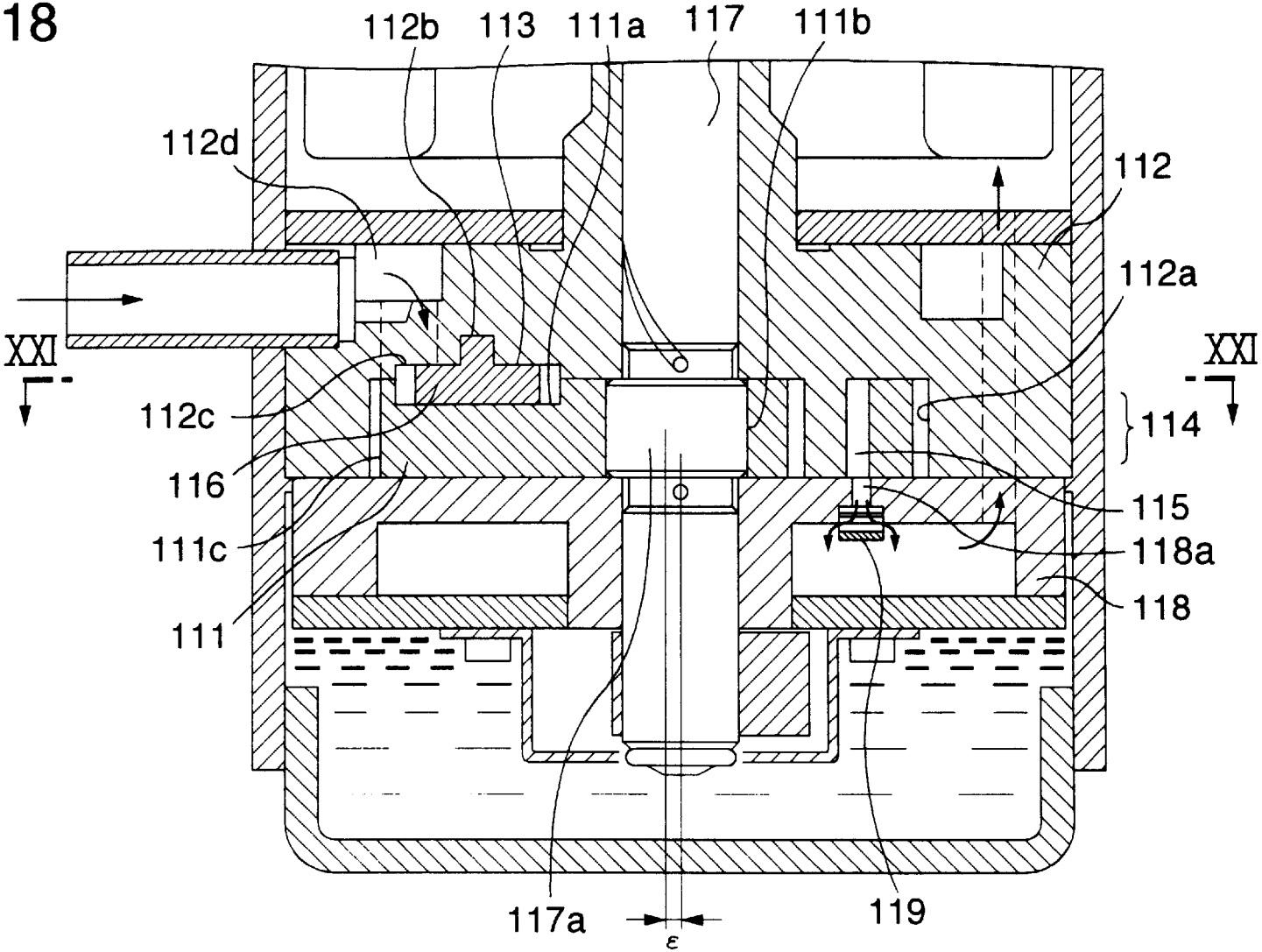
FIG. 18 is a vertical cross-sectional view showing a compression element of the invention.

FIG. 18 is a vertical cross-sectional view showing a compression element 114 in which the configuration of an outer peripheral surface of an orbiting piston 111 as well as the configuration of an inner peripheral surface of a cylinder 112 is formed by three volute portions, and Oldham coupling-type rotation prevention mechanisms 113 are used. In the case where the configuration of an outer peripheral surface of an orbiting piston as well as the configuration of an inner peripheral surface of a cylinder is formed by four volute portions, an Oldham key of a cross-shape can be used. However, in the case where these configurations are formed by three volute portions, grooves cannot be formed or cut in the orbiting piston and the cylinder in diametrical directions.

Therefore, in the embodiment of FIG. 18, the Oldham coupling type is used as described below.

The outer peripheral surface 111*c* of the orbiting piston 111 is engaged with the inner peripheral surface 112*a* of the cylinder 112 in such a manner that they are eccentric with respect to each other by an amount equal to an orbital radius ϵ. Each of the Oldham coupling-type rotation prevention mechanisms 113 abuts against end surfaces of the orbiting piston 111 and the cylinder 112 to be disposed inwardly of compression working chambers 115. A working fluid flows in a manner similar to that of FIG. 2, and therefore explanation thereof will be omitted.

Figure 19:
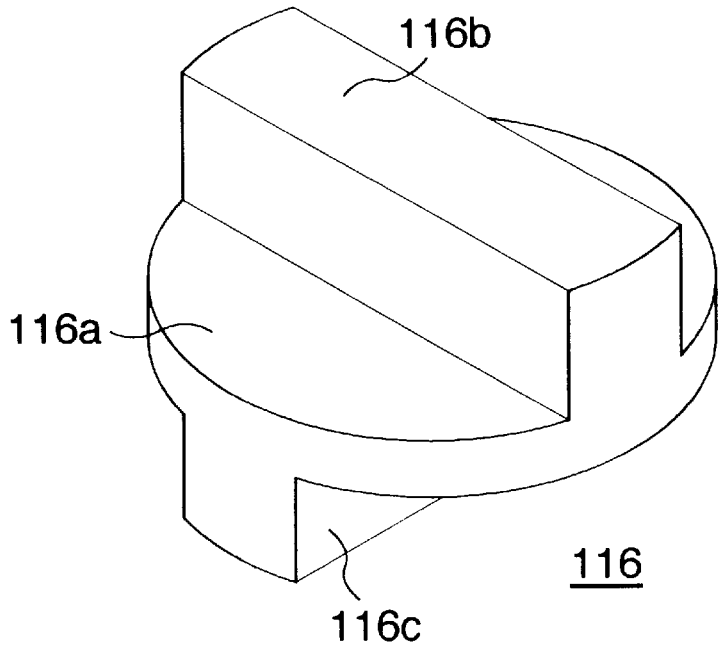
FIG. 19 is a view showing the appearance of an Oldham key-type rotation prevention mechanism.

FIG. 19 shows the appearance of an Oldham coupling 116. A notch portion 116*b* (at the cylinder side) and a notch portion 116*c* (at the piston side), respectively, are formed on upper and lower sides or surfaces of a pedestal 116*a* of the Oldham coupling 116 to extend perpendicular to each other, and pass through an axis of the pedestal 116*a*, the notch portions 116*b* and 116*c* having the same width.

Figure 20:
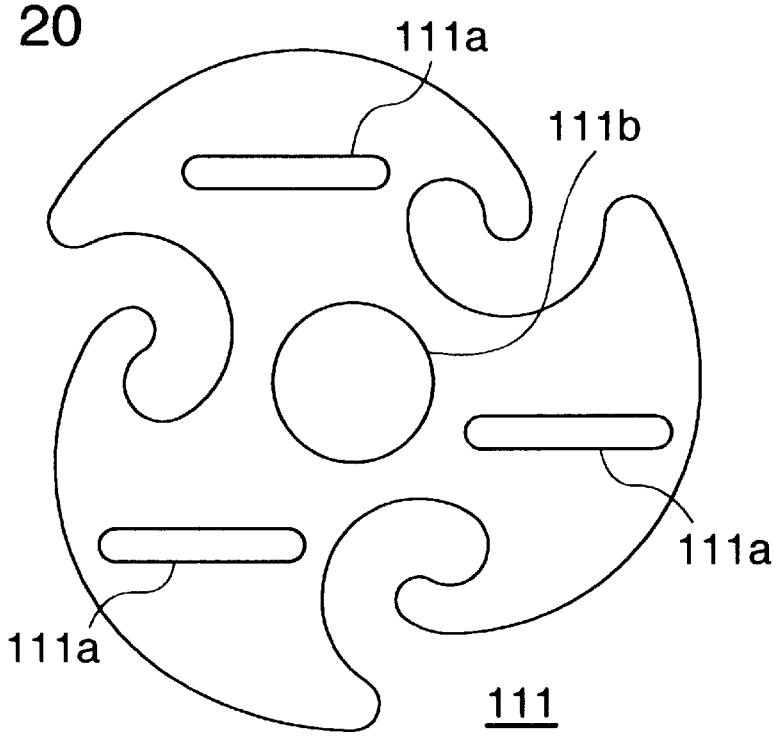
FIG. 20 is a view showing the appearance of an orbiting piston of the invention.

As shown in FIG. 20, three grooves 111*a* are formed in the end surface of the orbiting piston 111 to extend horizontally and disposed around a bearing hole 111*b* in the orbiting piston 111. The notch portions 116*c* of the Oldham couplings 116, respectively, are received in the grooves 111*a* for smooth sliding movement therealong. The length of each of the grooves 111*a* is so determined that the notch portion 116*c* of the Oldham coupling 116 received therein, can reciprocally move horizontally at least by a distance equal to an orbital radius ϵ. The width and depth of the groove 111*a* are so determined that the notch portion 116*c* of the Oldham coupling 116 can smoothly slide.

Grooves 112*b* and flat surface portions 112*c* are formed in that end surface of the cylinder 112 abuting against the orbiting piston 111. The notch portions 116*b* of the Oldham couplings 116, respectively, are received in the grooves 112*b* for reciprocal movement a distance equal to the orbital radius ϵ, and the pedestals 116*a* of the Oldham couplings 116 are held in smooth sliding contact with the flat portions 112*c*, respectively.

For a compression operation, FIGS. 21A to 21D are views taken along the lines XXI-XXI of FIG. 18. The character O denotes the center of the orbiting piston 111, and the character O' denotes the center of the cylinder 112 and a drive shaft 117. The configuration of the inner peripheral surface 112*a* of the cylinder 112 is formed by combining three volute portions, each formed by a multi-arc-shaped curve, together in smoothly-continuous relation to one another.

The outer peripheral surface 111*c* of the orbiting piston 111 is formed according to the same principle, and is similar in shape or contour to the inner peripheral surface 112*a* of the cylinder 112, and is smaller than it by an amount corresponding to the orbital radius ϵ (=OO'). The characters a, b, c, d, e and f denote points of contact (engagement) between the outer peripheral surface 111*c* of the orbiting piston 111 and the inner peripheral surface 112*a* of the cylinder 112 which form the compression working chambers. The three Oldham couplings 116 of the rotation prevention mechanism 113 are disposed at equal intervals around the center O of the orbiting piston 111.

The bearing hole 111*b* in the orbiting piston 111 is fitted on an eccentric portion 117*a* of the drive shaft 117, and therefore the orbiting piston 111 is engaged with the cylinder 112 in such a manner that they are eccentric with respect to each other by an amount equal to the orbital radius ϵ. At this time, each Oldham coupling 116 of the rotation prevention mechanism 113 is disposed between the cylinder 112 and the orbiting piston 111 to slidably contact the groove 111*a*, formed in the end surface of the orbiting piston 111, the groove 112*b* perpendicular to the groove 111*a* and the flat surface portion 112*c* provided at the cylinder 112. The grooves 111*a* and 112*a* are so determined in shape and size that the notch portions 116*c* and 116*b* can reciprocally move by a distance equal to the orbital radius ϵ, and therefore the position of each Oldham coupling 116 is determined according to the position of engagement of the orbiting piston 111 with the cylinder 112.

Figures 21A, 21B, 21C, 21D:
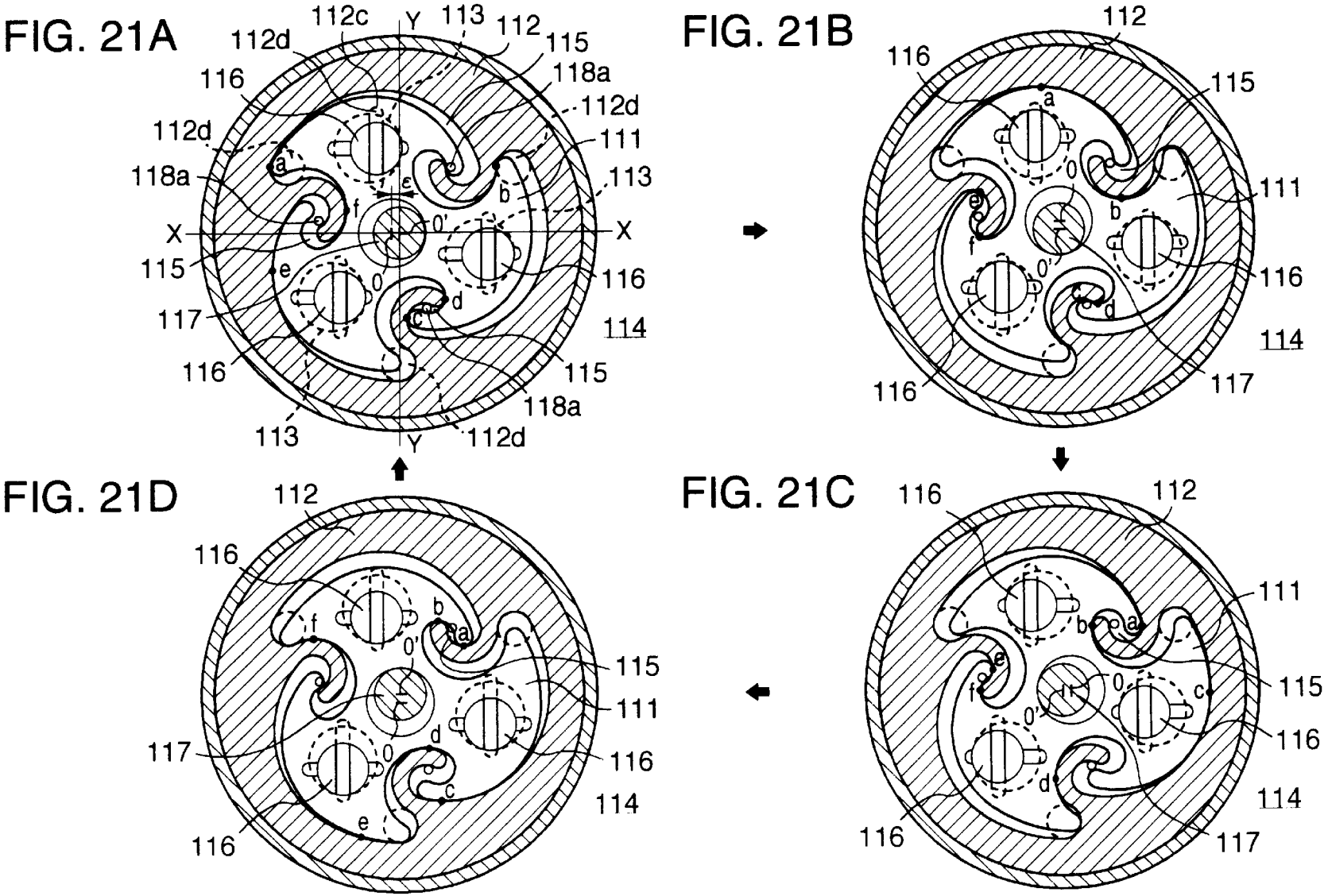
FIGS. 21A to 21D are views taken along the lines XXI—XXI of FIG. 18, showing the principle of the operation of the compression element.

For the compression working chamber 115 formed between the contact point a and the contact point b in FIGS. 21A to 21D (the chamber is divided into two compression working chambers, with a discharge port 118*a* interposed therebetween, at the time of the end of the suction stroke, but these two chambers are combined into one chamber immediately when the compression stroke begins.), FIG. 21A shows a state in which the drawing of a working fluid into this compression working chamber 115 from a suction port 112*d* is finished, FIG. 21B showing a state resulted from rotating the drive shaft 117 clockwise through 90 degrees from this state, FIG. 21C showing a state resulted from rotating the drive shaft 117 clockwise through 90 degrees from the state of FIG. 21B, and FIG. 21D showing a state resulted from rotating the drive shaft 117 clockwise through 90 degrees from the state of FIG. 21C, and when the drive shaft 117 is further rotated clockwise through 90 degrees, the compression element is returned to the initial state of FIG. 21A. Therefore, as the rotation of the drive shaft 117 proceeds, the volume of the compression chamber 115 is reduced, and since the discharge port 118*a* formed in an auxiliary bearing member 118 is closed by a discharge valve 119, the compression of the working fluid is effected.

At this time, the notch portion 116*b* of each Oldham coupling 116 constituting the rotation prevention mechanism 113 and engaged with the cylinder 112 reciprocally moves in a Y-axis direction relative to the cylinder 112 with an amplitude equal to the orbital radius ϵ whereas the notch portion 116*c* of the Oldham coupling 116, engaged with the orbiting piston 111, reciprocally moves on the orbiting piston 111 with the same amplitude in an X-axis direction perpendicular to the Y-axis direction, which is 90 degrees out of phase with the Y-axis direction. Therefore, the orbiting piston 111 makes a revolution (orbital motion), composed of these reciprocal motions, relative to the cylinder 112, and its orbit (path of travel) is equal to that of the center of the orbiting piston 111.

Therefore, the provision of the Oldham coupling-type rotation prevention mechanism 113 causes the orbiting piston 111 to make an orbital motion around the center of the fixed cylinder 112 with the orbital radius ϵ without rotation while kept in the same posture. The plurality of compression working chambers 115 formed around the center of the orbiting piston 111 continuously effect the suction, compression and discharge strokes in a phase-shifting manner.

As a result, in the embodiment of FIG. 18, a rotating moment tending to rotate the orbiting piston 111 by the internal pressure of the compression working chambers 115 produced when the working fluid is compressed is completely avoided, and a positive orbital motion can be imparted to the orbiting piston 111. Besides, a gap at the point of contact in the compression working chambers formed between the orbiting piston 111 and the cylinder 112 can be kept constant to reduce the friction and wear, so that the compression element 114 of a high reliability can be provided. Furthermore, the Oldham coupling-type rotation prevention mechanisms 113 can be disposed inwardly of the compression working chambers 115 to make the compression element 114 smaller in diameter. Further, the precision involved in the parts of the Oldham couplings 116 of the Oldham coupling-type rotation prevention mechanisms 113 can be easily controlled, so that the rotation prevention mechanism of a high precision can be provided.

The Oldham coupling-type rotation prevention mechanisms of this embodiment can be applied to a fluid machine of the type in which the configuration of an outer peripheral surface of an orbiting piston as well as the configuration of an inner peripheral surface of a cylinder is formed by four volute portions.

Figure 22:
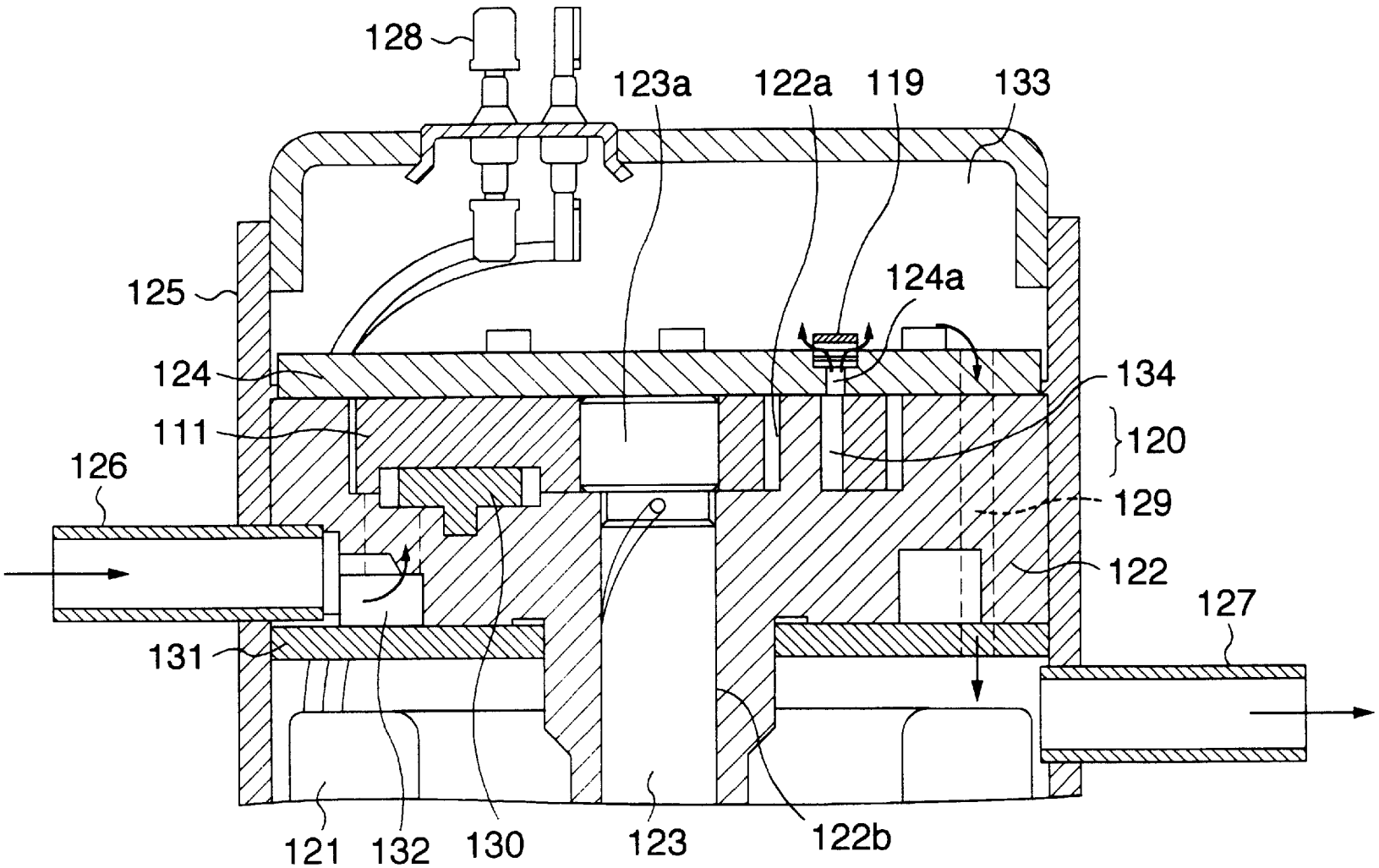
FIG. 22 is a vertical cross-sectional view showing a compression element of the invention.

FIG. 22 is a vertical cross-sectional view showing a displacement type compressor of the present invention. In this embodiment, the arrangement of a compression element 120 is different from that of FIG. 18, and this different portion will be mainly described.

In FIG. 22, the compression element 120 of the invention is disposed above an electrically-operating element 121 for driving this compression element 120. An orbiting piston 111 of the compression element 120 is engaged with vanes 122*a* of a cylinder 122, and is provided at its central portion with a bearing hole 111*b* which is fitted on an eccentric portion 123*a* of a drive shaft 123. The drive shaft 123 is borne by a main bearing portion 122*b* formed at the cylinder 122 to support the orbiting piston 111, fitted on the eccentric portion 123*a*, in a cantilever manner. Discharge ports 124*a* are formed in a discharge cover 124, and a reed-type discharge valve 119 is provided for opening and closing the discharge port 124*a*. Oldham coupling-type rotation prevention mechanisms 130 are provided between the orbiting piston 111 and the cylinder 122 to be disposed inwardly of compression working chambers 129.

The principle of the operation of the Oldham coupling-type rotation prevention mechanisms 130 as well as the flow of a working fluid is similar to that described above for FIG. 18, and therefore explanation thereof will be omitted.

As a result, in the embodiment of FIG. 22, the drive shaft 123 of the cantilever support construction dispenses with an auxiliary bearing member, a balancer, an oil cover and so on to achieve cost reduction due to the reduction of the number of the component parts of the displacement type compressor, enhancement of the productivity, and the compact, light-weight design.

Figure 23:
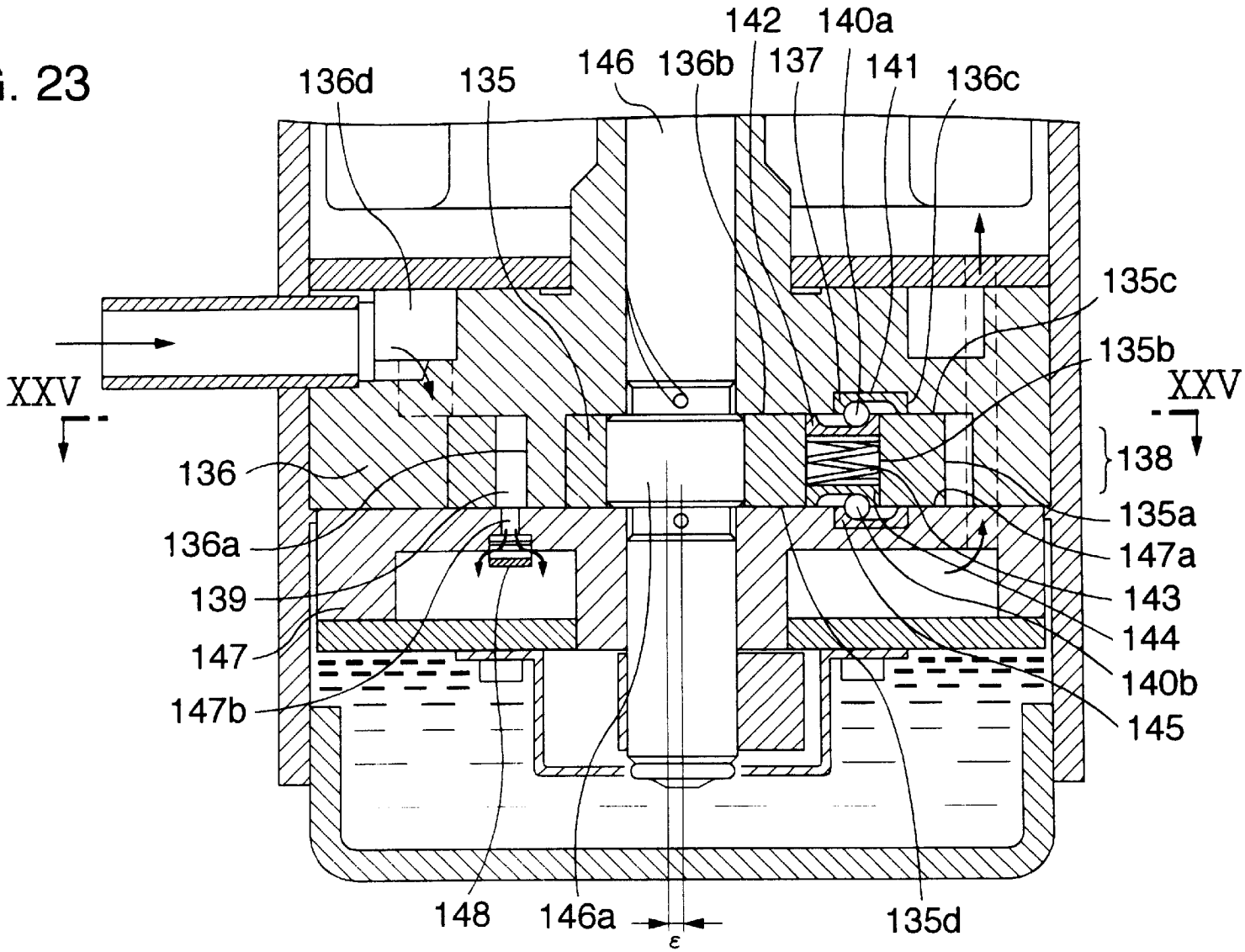
FIG. 23 is a vertical cross-sectional view showing a compression element of the invention.

FIG. 23 is a vertical cross-sectional view showing a compression element 138 in which the configuration of an outer peripheral surface 135*a* of an orbiting piston 135 as well as the configuration of an inner peripheral surface 136*a* of a cylinder 136 is formed by three volute portions, and ball coupling-type rotation prevention mechanisms 137 are used.

The outer peripheral surface 135*a* of the orbiting piston 135 is engaged with the inner peripheral surface 136*a* of the cylinder 136 in such a manner that the former is offset from the latter by an amount equal to an orbital radius $\epsilon$, thereby forming compression working chambers 139. The ball coupling-type rotation prevention mechanisms 137 abut against end surfaces of the orbiting piston 135 and the cylinder 136 to be disposed inwardly of the compression working chambers 139. The flow of a working fluid is similar to that described above for FIG. 18, and therefore explanation thereof will be omitted.

Figure 24:
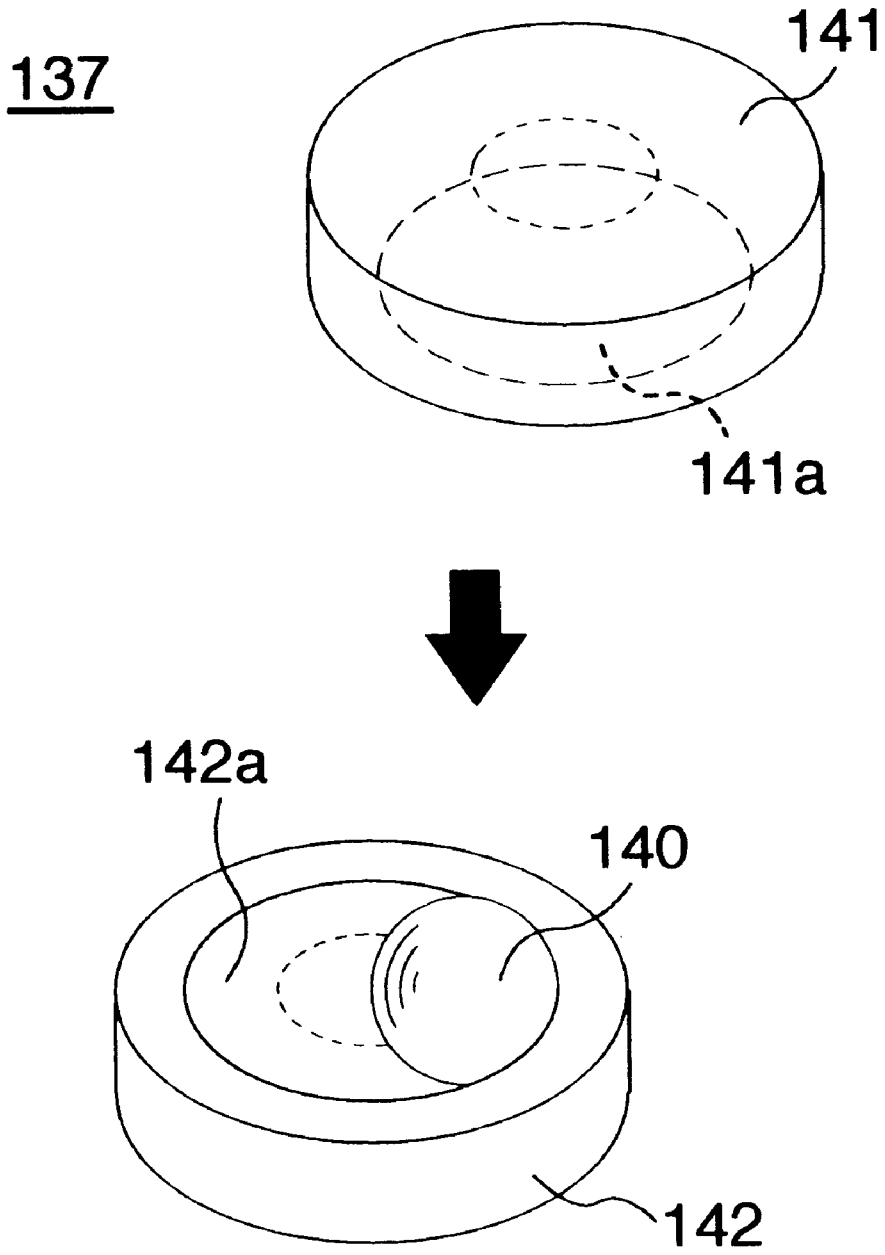
FIG. 24 is a view showing an appearance of a ball coupling-type rotation prevention mechanism of the invention.

As shown in FIG. 24, the ball coupling-type rotation prevention mechanism 137 comprises a ball member 140, and a pair of reception seats 141 and 142 holding the ball member 140 therebetween in a manner to allow the sliding or rolling of the ball member 140, and formed with corner portions 141*a* and 142*a* each having the same curvature as that of the ball member 140.

The reception seats 141, respectively, are fixedly fitted in holes 136*c* which are formed in the end surface 136*b* of the cylinder 136 and are circumferentially disposed around the center of the cylinder 136. The reception seats 142, respectively, are slidably fitted in upper end portions adjacent to the upper end surface 135*c* of holes 135*b*, which are formed in the orbiting piston 135 and are circumferentially disposed at equal intervals around the center of the orbiting piston 135. The ball member 140*a* is slidably held between each pair of reception seats 141 and 142, which have their corner portions 141*a* and 142*a* opposed to each other, in such a manner that the reception seats 141 and 142 are offset from each other by an amount equal to the orbital radius $\epsilon$. A reception seat 144 is received in the lower end portion (adjacent to the lower end surface 135*d*) of each of the holes 135*b* in the orbiting piston 135, and a spring member 143 is received within the hole 135*b* to act between the reception seats 142 and 144, a reception seat 145 is provided in each of holes in an end surface 147*a* of an auxiliary bearing member 147, and a ball member 140*b* is slidably held between each pair of reception seats 144 and 145. The arrangement of the reception seats 141 and 142 and ball member 140*a* and the arrangement of the associated reception seats 144 and 145 and ball member 140*b* are symmetrical with respect to each other.

FIGS. 25A to 25D are views taken along the lines XXV—XXV of FIG. 23. The character O denotes the center of the orbiting piston 135, and the character O' denotes the center of the cylinder 136 and a drive shaft 146. The configuration of the inner peripheral surface 136*a* of the cylinder 136 is formed by combining three volute portions, each formed by a multi-arc-shaped curve, together in smoothly-continuous relation to one another.

The outer peripheral surface 135*a* of the orbiting piston 135 is formed according to the same principle described above for the cylinder 136, and is similar in shape or contour to the inner peripheral surface 136*a* of the cylinder 136, and is smaller than it by an amount corresponding to the orbital radius $\epsilon$ (=OO'). The characters a, b, c, d, e and f denote points of engagement in the compression working chambers between the outer peripheral surface 135*a* of the orbiting piston 135 and the inner peripheral surface 136*a* of the cylinder 136.

The three ball coupling-type rotation prevention mechanisms 137, respectively, are provided in the holes 135*b* which are disposed at equal intervals circumferentially around the center of the orbiting piston 135. A bearing hole 135*e* in the orbiting piston 135 is fitted on an eccentric portion 146*a* of the drive shaft 146, whereby the orbiting piston 135 is engaged with the cylinder 136 in such a manner that they are eccentric with respect to each other by an amount equal to the orbital radius $\epsilon$. At this time, each of the ball coupling-type rotation prevention mechanisms 137 is constituted by the reception seats 142 and 144, respectively, provided in the upper and lower end portions of the hole 135*b* disposed adjacent to the upper and lower end surfaces 135*c* and 135*d* of the orbiting piston 135, the reception seats 141 and 145, respectively, provided in the end surface 136*b* of the cylinder 136 and the end surface 147*a* of the auxiliary bearing member 147, the ball member 140*a* held between the reception seats 141 and 142, and the ball member 140*b* held between the reception seats 144 and 145. In this case, the reception seat 141 mounted on the cylinder 136 and the reception seat 145 mounted on the auxiliary bearing member 147 are offset by an amount equal to the orbital radius ϵ to be disposed in the same positional relation, so that the position of the ball members 140*a* and 140*b* is determined according to the position of engagement of the orbiting piston 135 with the cylinder 136.

Figure 25B:
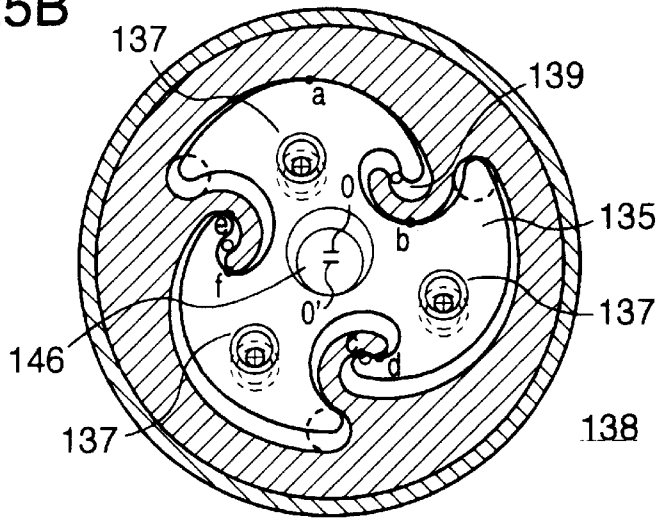
FIGS. 25A to 25D are views taken along the line XXV—XXV of FIG. 23, showing the principle of the operation of the compression element.
Figure 25C:
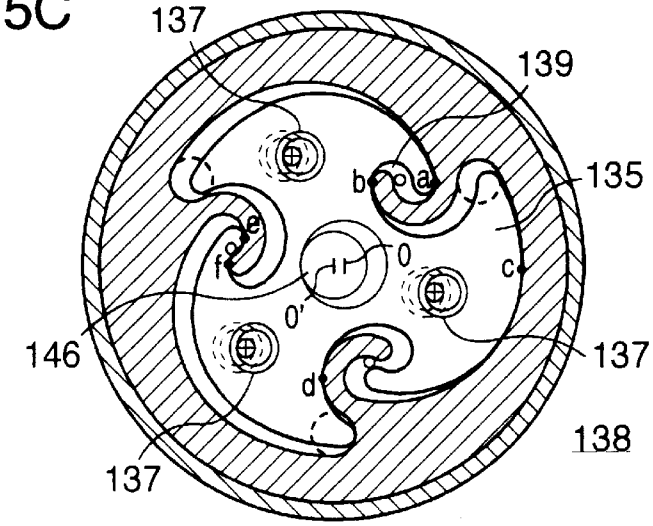
Figure 25A:
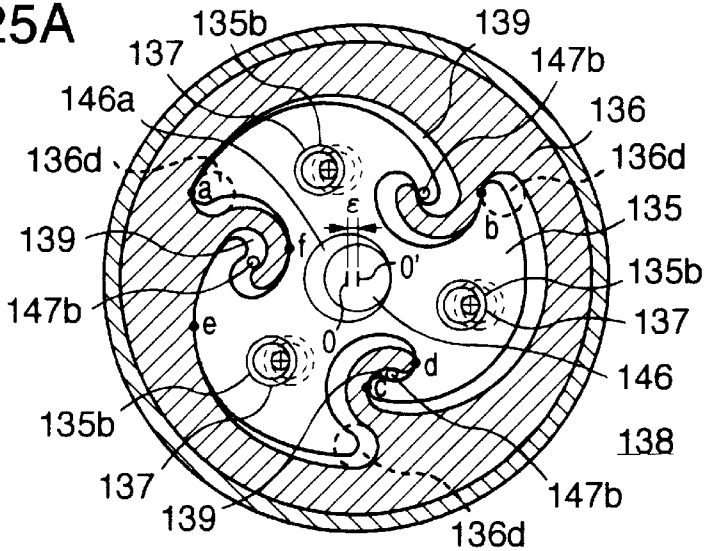
Figure 25D:
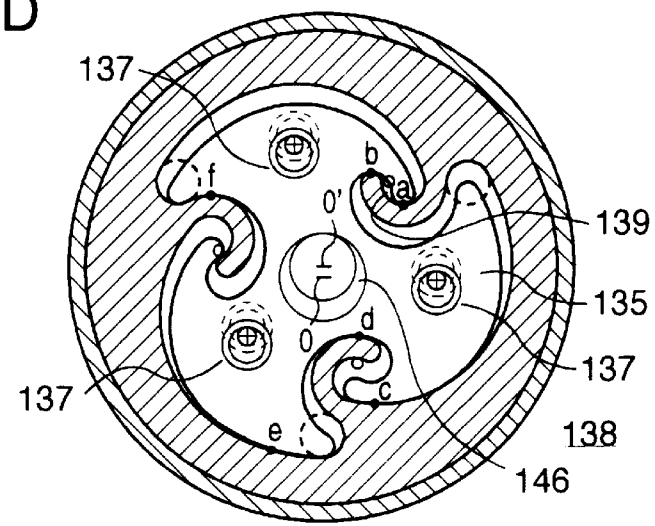

For the compression working chamber 139 formed between the contact point a and the contact point b (the chamber is divided into two compression working chambers, with a discharge port 147*b* interposed therebetween, at the time of the end of the suction stroke, but these two chambers are united into one chamber immediately when the compression stroke begins.), FIG. 25A shows a state in which the drawing of a working fluid into this compression working chamber 139 from a suction port 136*d* is finished, FIG. 25B showing a state resulted from rotating the drive shaft 146 clockwise through 90 degrees from this state, FIG. 25C showing a state resulted from rotating the drive shaft 146 clockwise through 90 degrees from the state of FIG. 25B, and FIG. 25D showing a state resulted from rotating the drive shaft 146 clockwise through 90 degrees from the state of FIG. 25C, and when the drive shaft 146 is further rotated clockwise through 90 degrees, the compression element is returned to the initial state of FIG. 25A. Therefore, as the rotation of the drive shaft 146 proceeds, the volume of the compression chamber 139 is reduced, and since the discharge port 147*b* formed in the auxiliary bearing member 147 is closed by a discharge valve 148, so that the compression of the working fluid is effected.

At this time, in each of the ball coupling-type rotation prevention mechanisms 137, the ball 140*a*, while slipping in the groove portion between the reception seats 141 and 142, respectively, provided at the fixed cylinder 136 and the hole 135*b* in the orbiting piston 135, makes an orbital motion (whose orbit is equal to that of the center of the orbiting piston 135) around the center of the reception seat 141 with the orbital radius ϵ (equal to the distance between the center O of the orbiting piston 135 and the center O' of the cylinder 136) in the sequence of FIG. 25A, FIG. 25B, FIG. 25C, FIG. 25D and FIG. 25A. At the same time the ball 140*b*, while slipping in the groove portion between the reception seats 144 and 145, respectively, provided at the hole 135*b* and the auxiliary bearing member 147, makes an orbital motion (whose orbit is equal to that of the center of the orbiting piston 135) around the center of the reception seat 145 with the orbital radius ϵ in the sequence of FIG. 25A, FIG. 25B, FIG. 25C, FIG. 25D and FIG. 25A. A preload is applied to the ball members 140*a* and 140*b* by the spring member 143 acting between the reception seats 142 and 144 provided symmetrically in the hole 135*b* in the orbiting piston 135, and therefore the ball members 140*a* and 140*b* are prevented from being dislodged from the associated reception seats in a radial direction.

Therefore, the ball coupling-type rotation prevention mechanism 137 allows the orbiting piston 135 to make an orbital motion around the center of the fixed cylinder 136 with the orbital radius ϵ without rotation while kept in the same posture. The plurality of compression working chambers 139 formed around the center of the orbiting piston 135 continuously effect the suction, compression and discharge strokes in a phase-shifting manner.

As a result, in the embodiment of FIG. 23, similar effects as described above for FIG. 18 can be obtained, and a rotating moment tending to rotate the orbiting piston 135 by the internal pressure of the compression working chambers 139 produced when the working fluid is compressed is completely avoided to enable imparting a positive orbital motion to the orbiting piston 135. Besides, a gap at the point of contact in the compression working chambers between the orbiting piston 135 and the cylinder 136 can be kept constant to reduce the friction and wear, so that the compression element 138 of a high reliability can be provided. Furthermore, the ball coupling-type rotation prevention mechanisms 137 can be disposed inwardly of the compression working chambers 139, so that the compression element 138 can be formed into a smaller diameter.

Figure 26:
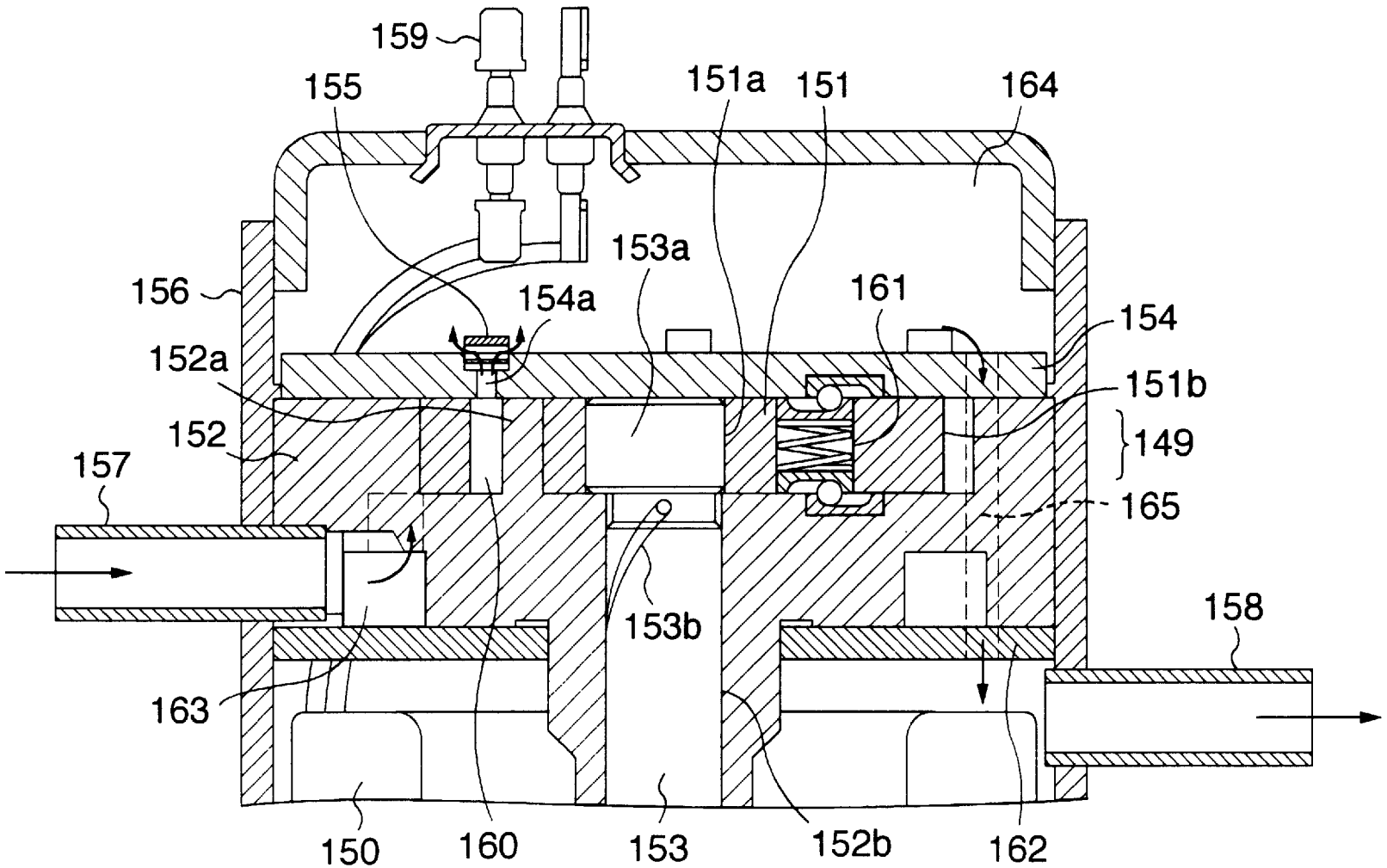
FIG. 26 is a vertical cross-sectional view showing a compression element of the invention.

FIG. 26 is a vertical cross-sectional view showing a displacement type compressor of the present invention. In this embodiment, the arrangement of a compression element 149 is different from that of FIG. 23, and this different portion will be mainly described.

In FIG. 26, the compression element 149 of the invention is disposed above an electrically-operating element 150 for driving this compression element 149. An orbiting piston 151 of the compression element 149 is engaged with vanes 152*a* of a cylinder 152, and is provided at its central portion with a bearing hole 151*a* which is fitted on an eccentric portion 153*a* of a drive shaft 153. The drive shaft 153 is borne by a main bearing portion 152*b* formed at the cylinder 152 to support the orbiting piston 151, fitted on the eccentric portion 153*a*, in a cantilever manner. Discharge ports 154*a* are formed in a discharge cover 154, and a reed-type discharge valve 155 is provided for opening and closing the discharge port 154*a*. Ball coupling-type rotation prevention mechanisms 161 are provided between the orbiting piston 151 and the cylinder 152 to be disposed inwardly of compression working chambers 160. The principle of the operation of the ball coupling-type rotation prevention mechanisms 161 is similar to that described above for FIG. 23, and therefore explanation thereof will be omitted.

As indicated by arrows in FIG. 26, a working fluid entering into a closed vessel 156 through a suction pipe 157 flows into the compression element 149 via a suction chamber 163 formed by a suction port 152*c* and a suction cover 162 mounted on the cylinder 152, and when the drive shaft 153 is rotated by the electrically-operating element 150, the orbiting piston 151 revolves (that is, makes an orbital motion) through the eccentric portion 153*a* of the drive shaft 153, so that the volume of the compression working chamber 160 is reduced, thereby effecting the compression operation. The compressed working fluid opens the discharge valve 155 via the discharge port 154*a* formed in the discharge cover 154 to flow into a discharge chamber 164 to pass through a communication passage 165 into an electrically-operating element-side space (containing the electrically-operating element 150 to be discharged from a discharge pipe 158 to the exterior of the compressor. At this time, the ball coupling-type rotation prevention mechanisms 161 can completely avoid a rotating moment acting on the orbiting piston 151.

As a result, in the embodiment of FIG. 26, the drive shaft 153 is of the cantilever support construction dispenses with an auxiliary bearing member, a balancer, an oil cover and so on to achieve cost reduction due to the reduction of the number of the component parts of the displacement type compressor, enhancement of the productivity, and the compact, lightweight design of the displacement type compressor.

As described above, in the embodiment of FIG. 26, the configuration of an outer peripheral surface 151*b* of the orbiting piston 151 as well as the configuration of an inner peripheral surface 152*d* of the cylinder 152 are formed by three or four volute portions. However, the rotation prevention mechanisms of the above-mentioned types can be suitably used according to the configuration of the compression element in which the outer peripheral surface configuration of the orbiting piston as well as the inner peripheral surface configuration of the cylinder is formed by a practical number of (2 to 10) volute portions.

As the number of volute portions forming the outer peripheral surface configuration of the orbiting cylinder as well as the inner peripheral surface configuration of the cylinder increases within the practical range (2 to 10), the following advantages are achieved:

(1) A torque variation is reduced, and vibrations and noises can be reduced.

(2) Assuming that the cylinder has an outer diameter of a predetermined value, the same suction capacity can be obtained even if the height of the cylinder is reduced, and therefore the size of the compression element can be reduced.

(3) The rotating moment acting on the orbiting piston is reduced, use of the construction in combination with the rotation prevention mechanism can completely avoid the rotating moment, a mechanical friction loss in the sliding portions of the orbiting piston and the cylinder can be reduced, and the reliability can be enhanced.

(4) A compression pulsation in the suction and discharge pipes is reduced, so that the vibrations and noises can be further reduced. As a result, a fluid machine (a compressor, a pump and so on) with no pulsating flow, which has been required in the medical and industrial fields, can be achieved.

In the embodiments described above, the interior of the closed vessel is under the discharge pressure (high pressure). Therefore, the pressure acts on that side or surface of the auxiliary bearing member facing away from the orbiting piston, thereby preventing the auxiliary bearing member from being displaced out of contact with the orbiting piston and the cylinder.

Figure 27:
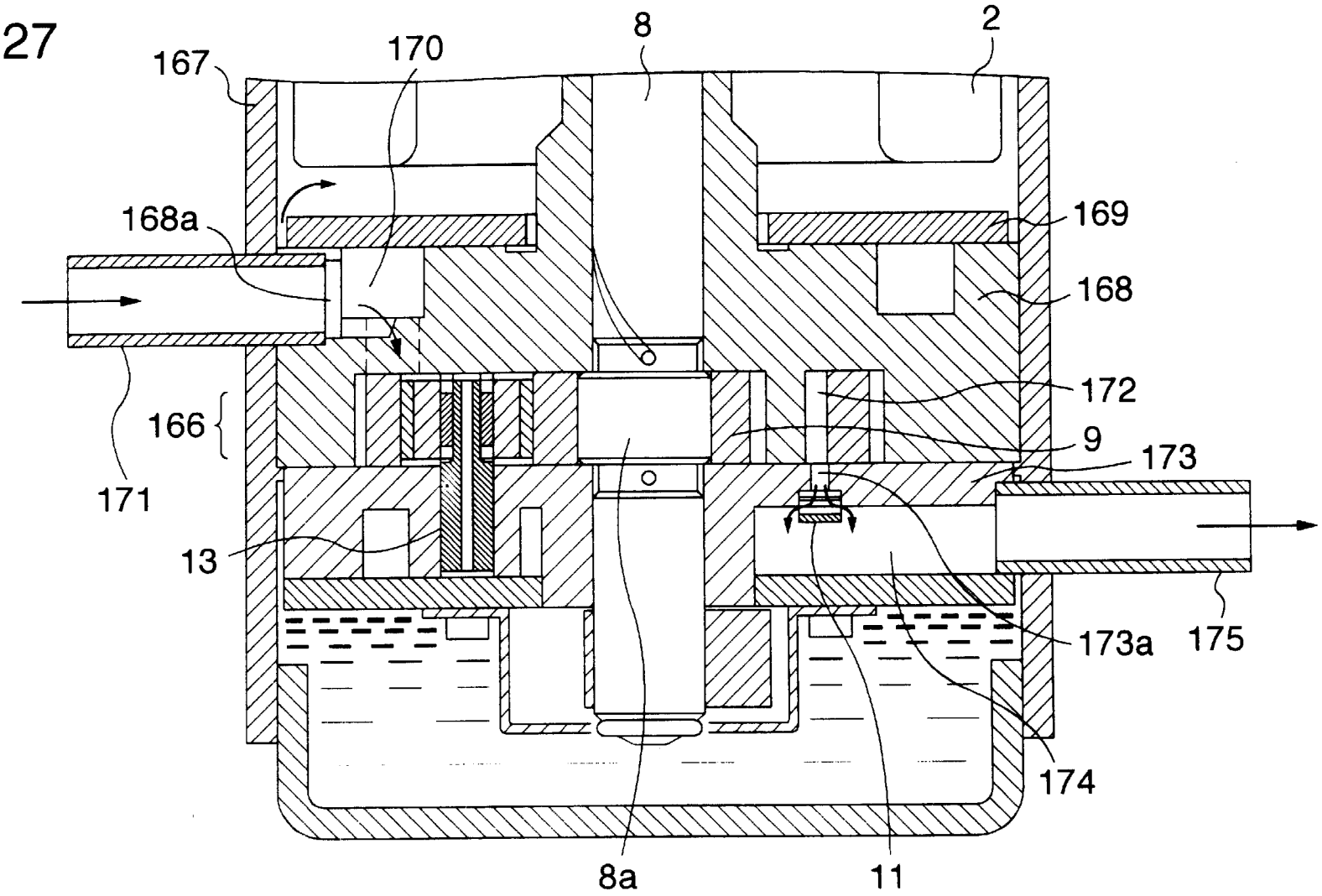
FIG. 27 is a vertical cross-sectional view showing a compression element of the invention.

FIG. 27 is a vertical cross-sectional view showing a low pressure-type compression element 166 of the invention. This embodiment differs from the embodiment of FIG. 3 in that the pressure within a closed vessel is low, and this different portion will be mainly described.

The reference numeral 166 denotes the compression element of the invention, 2 an electrically-operating element for driving this compression element, and 167 the closed vessel containing the compression element 166 and the electrically-operating element 2. The compression element 166 is provided with pin-type rotation prevention mechanisms 13. A suction cover 169 is held against an end surface of a cylinder 168 to form a suction chamber 170. The suction chamber 170 is in communication with that portion of the internal space of the closed vessel 167 in which the electrically-operating element 2 is provided. The principle of the operation of the pin-type rotation prevention mechanisms 13 is similar to that described above for FIG. 3, and therefore explanation thereof will be omitted.

As a result, in the embodiment of FIG. 27, as indicated by arrows in FIG. 27, a working fluid entering into the closed vessel 167 through a suction pipe 171 flows into the compression element 166 via the suction chamber 170 formed by a suction port 168*a* and the suction cover 169 mounted on the cylinder 168, and when a drive shaft 8 is rotated by the electrically-operating element 2, an orbiting piston 9 fitted on an eccentric portion 8*a* of the drive shaft 8 revolves (that is, makes an orbital motion), so that the volume of compression working chambers 172 is reduced, thereby continuously effecting the compression operation. The compressed working fluid opens a discharge valve 11 via a discharge port 173*a* formed in an auxiliary bearing member 173 to flow into a discharge chamber 174 to be discharged from a discharge pipe 175 to the exterior of the compressor. At this time, since the suction chamber 170 is in communication with the internal space of the closed vessel 167, the interior of the closed vessel is under the suction pressure (low pressure).

By providing this low-pressure system in which the pressure within the closed vessel 167 is low, the following advantages are achieved:

(1) The heating of the electrically-operating element 2 by the compressed working fluid of a high temperature is reduced, and the motor efficiency is enhanced, so that the performance of the compressor can be enhanced.

(2) When a fluid compatible with the lubricating oil, such as freon, is used as the working fluid, the rate of dissolving of the working fluid in the lubricating oil is reduced because of the low pressure, and bubbles are prevented from developing in the lubricating oil supplied to the bearings and others.

(3) The pressure-resistance of the closed vessel 167 can be reduced, and the constituent parts of the compressor can be reduced in thickness and weight.

The low pressure-type compression element 166 of the embodiment of FIG. 27 can, of course, be applied to the type of compression elements in which the outer peripheral surface configuration of the orbiting piston 9 as well as the inner peripheral surface configuration of the cylinder 168 is formed by a practical number of (2 to 10) volute portions, and this low pressure-type compression element 166 can be used in combination with any of the above-mentioned various types of rotation prevention mechanisms.

Figure 28:
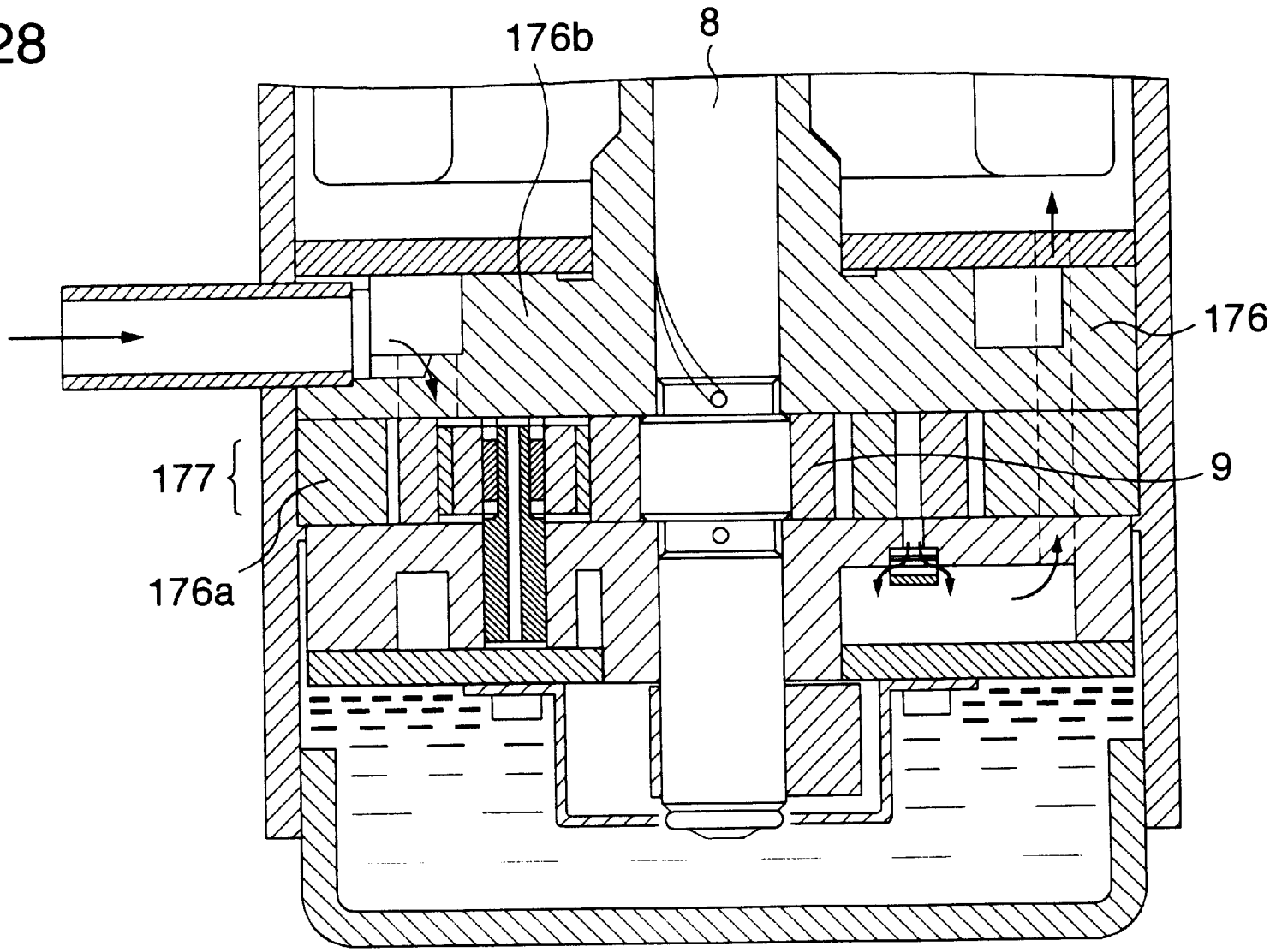
FIG. 28 is a vertical cross-sectional view showing a compression element of the invention.

In the embodiments described above, the cylinder and the bearing are formed integral with each other, and in this case there is encountered a problem that the processing or working of the bottom of the cylinder is difficult. FIG. 28 is a vertical cross-sectional view showing a compression element 177 of the invention which is provided in order to overcome this problem. This embodiment differs from the embodiment of FIG. 3 in that a cylinder 176 has a different construction, and this different portion will be mainly described.

Figure 29A:
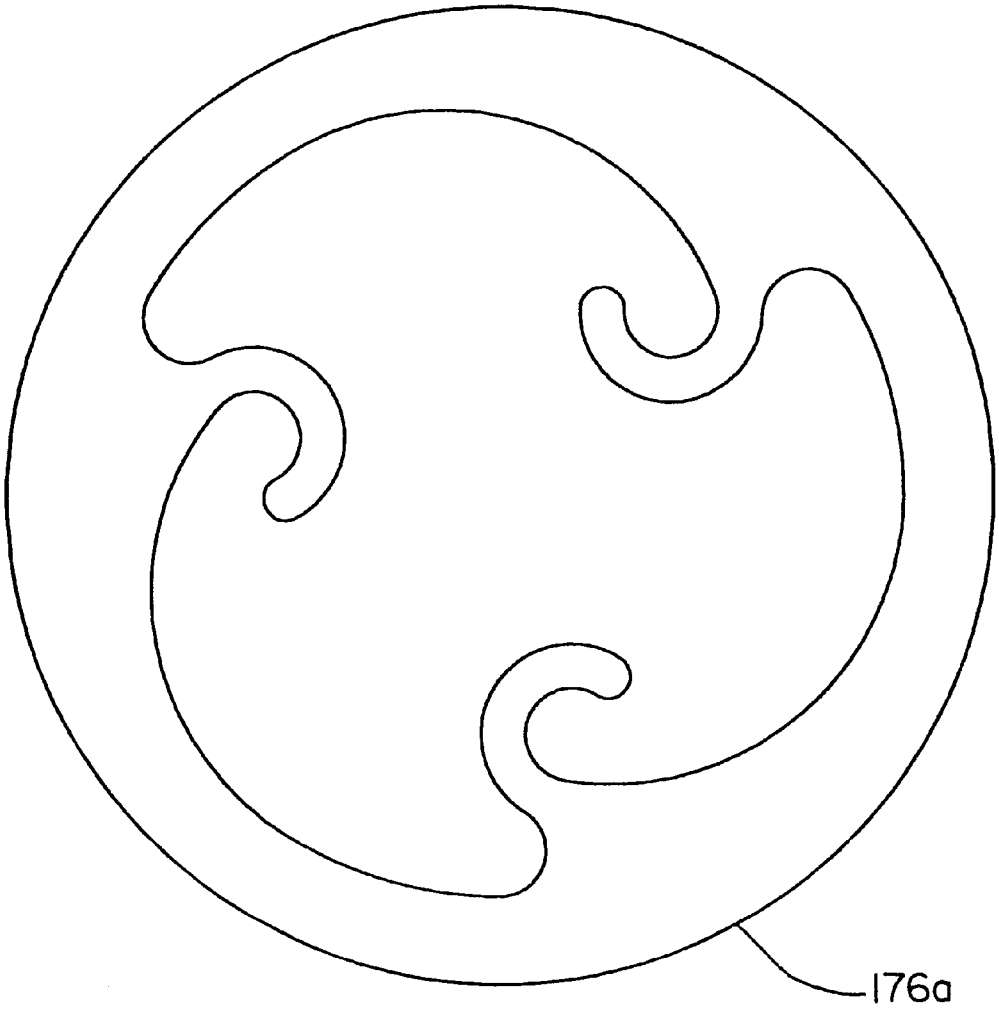
FIG. 29 is a view showing an appearance of a cylinder of the invention.
Figure 29B:
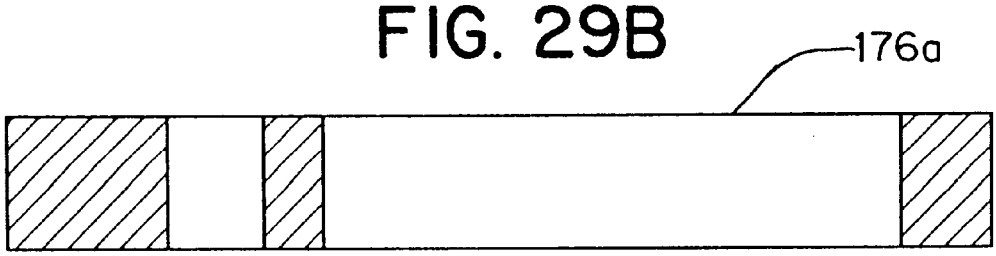

In FIG. 28, the cylinder 176 of the compression element 177 comprises a volute member 176*a* (see FIG. 29) engaged with an outer peripheral surface of an orbiting piston 9, and a main bearing member 176*b* which bears a drive shaft 8. The two members 176*a* and 176*b* abut against each other at their end surfaces to be positioned with respect to each other, and are fixed.

As a result, in the embodiment of FIG. 28, the range of choice of a method of processing the volute member 176*a* of the cylinder 176 as well as the range of choice of a material is made wider and the productivity can be enhanced. Besides, the dimensional precision with respect to the inner peripheral surface and height of the volute member 176*a* of the cylinder 176 can be enhanced, and the displacement type compressor of a high efficiency can be provided.

The construction of the cylinder 176 of the embodiment of FIG. 28 can be applied to the type of compression elements in which the inner peripheral surface configuration of the cylinder 176 is formed by a practical number of (2 to 10) volute portions, and this construction can be used in combination with any of the above-mentioned various types of rotation prevention mechanisms.

Figure 30:
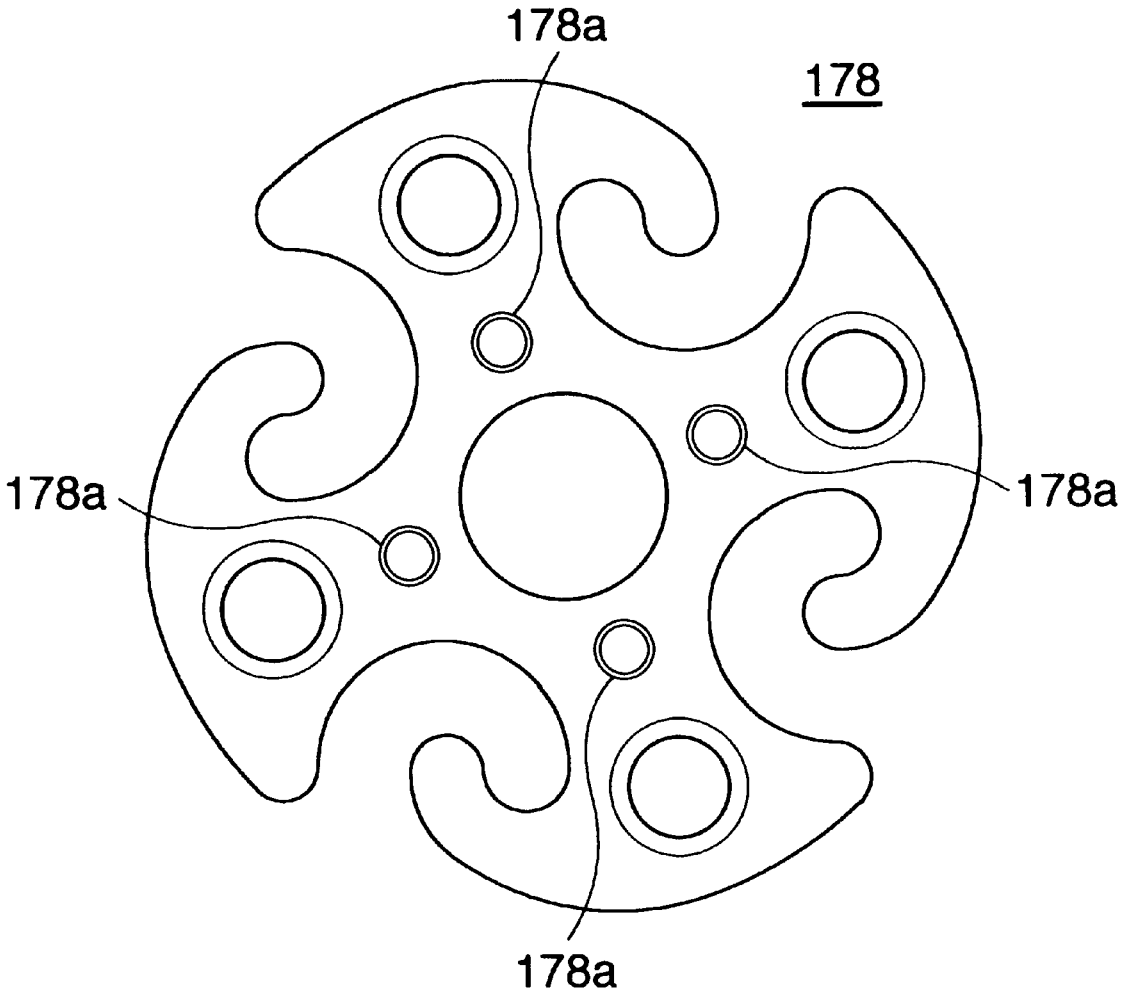
FIG. 30 is a view showing an orbiting piston of the invention.

FIG. 30 is a plan view of an orbiting piston 178 used in a modified form of the embodiment of FIG. 28 in which the configuration of an inner peripheral configuration of the piston as well as the configuration of an outer peripheral surface of the cylinder is formed by four volute portions.

Four screw holes 178*a* are formed in the orbiting piston 178, and are disposed at equal intervals circumferentially around the center of this piston. With this construction, the screw holes 178*a* can be used for positioning the orbiting piston 178 when processing the same, and also used for fixing the piston 178 to a processing jig to enhance the productivity. When disassembling the compression element, the orbiting piston 178 engaged with the inner peripheral surface and bottom surface of the cylinder can be easily removed by the use of the screw holes 178*a* without the influence of the viscosity of lubricating oil and so on.

The construction of the orbiting piston 178 of the embodiment of FIG. 30 can be applied to the type of compression elements in which the outer peripheral surface configuration of the orbiting piston 178 is formed by a practical number of (2 to 10) volute portions.

In the present invention, the rotation prevention mechanism is provided inwardly of the compression working chambers formed by the displacer and the cylinder, and with this construction, a rotating moment, which is produced as a reaction force of the compressed working fluid and acts on the displacer, can be completely avoided. Therefore there can be obtained the displacement type fluid machine of a high efficiency and a high reliability. Besides, the displacement type fluid machine, meeting with the purpose of use and the production facilities, can be obtained.

What is claimed is:

1. A displacement type fluid machine comprising a displacer and a cylinder which are provided between end plates;

wherein an outer peripheral surface of said displacer and an inner peripheral surface of said cylinder each have a shape comprising a plurality of volute portions formed by multi-arc shaped curves, and wherein the shape of the outer peripheral surface of said displacer is similar to but smaller than the shape of the inner peripheral surface of said cylinder such that when a center of said displacer and a center of said cylinder are aligned with each other, one space is formed by the outer peripheral surface of said displacer and the inner peripheral surface of said cylinder, and when said displacer is set to an orbiting portion, a plurality of spaces are formed by the outer peripheral surface of said displacer and the inner peripheral surface of said cylinder; and further comprising a rotation suppressing mechanism formed by through holes provided in a surface of said displacer opposite to one of said end plates, and pin members inserted into the holes and provided on said one of said end plates, said pin members being provided axially thereof with oil feed holes, and said oil feed holes being connected to an oil feed passage.

2. The displacement type fluid machine according to claim 1, wherein said oil feed holes are communicated to a lubricating oil in a bottom portion of a closed vessel in which said displacer and said cylinder are provided, to thereby define said oil feed passage.

3. A displacement type fluid machine, comprising:

a closed vessel;

a cylinder and a displacer provided between end plates in said closed vessel, said cylinder and said displacer being shaped wherein an outer peripheral surface of said displacer and an inner peripheral surface of said cylinder each have a shape comprising a plurality of volute portions formed by multi-arc shaped curves, and wherein the shape of the outer peripheral surface of said displacer is similar to but smaller than the shape of the inner peripheral surface of said cylinder such that when a center of said displacer and a center of said cylinder are aligned with each other, one space is formed by the outer peripheral surface of said displacer and the inner peripheral surface of said cylinder, and when said displacer is set to an orbiting position, a plurality of spaces are formed by an outer peripheral surface of said displacer and the inner peripheral surface of said cylinder;

a drive shaft provided in said closed vessel and having a central longitudinal axis aligned with a central axis of said cylinder and having an eccentric portion on which said displacer is mounted to make an orbital motion around the central longitudinal axis of said drive shaft and the central axis of said cylinder;

at least one rotation prevention mechanism comprising a pin member extending from said cylinder into a pin member receiving hole provided in said displacer, said pin member having an oil feed hole axially extending within said pin member; and a lubricating oil storage portion provided at a bottom of said closed vessel;

wherein said oil feed hole communicates with said lubricating oil storage portion.

4. The displacement type fluid machine according to claim 3, further comprising an eccentric member fitted within said pin member receiving hole, the eccentric member comprising a cylinder having an eccentric hole spaced from a center of the cylinder for receiving said pin member therein.

5. The displacement type fluid machine according to claim 4, further comprising a first bearing provided in said pin member receiving hole into which said eccentric member is provided and a second bearing member provided between said pin member and said eccentric member.

6. The displacement type fluid machine according to claim 5, wherein a plurality of said rotation prevention mechanisms are provided.

7. The displacement type fluid machine according to claim 6, wherein the plurality of rotation prevention mechanisms are spaced equidistantly around the center of said displacer.

8. The displacement type fluid machine according to claim 4, wherein a plurality of said rotation prevention mechanism are provided.

9. The displacement type fluid machine according to claim 8, wherein the plurality of rotation prevention mechanisms are spaced equidistantly around the center of said displacer.

* * * * *